US007097293B2

(12) United States Patent
Ichihashi et al.

(10) Patent No.: US 7,097,293 B2
(45) Date of Patent: Aug. 29, 2006

(54) PRESSURE DIFFERENTIAL REGULATING VALVE UNIT, A LIQUID CARTRIDGE AND A METHOD FOR ASSEMBLING A LIQUID CARTRIDGE

(75) Inventors: Akira Ichihashi, Nagano-ken (JP); Kenji Ito, Nagano-ken (JP); Satoshi Shinada, Nagano-ken (JP); Yasuto Sakai, Fukui-ken (JP); Taku Ishizawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 91 days.

(21) Appl. No.: 10/730,784

(22) Filed: Dec. 8, 2003

(65) Prior Publication Data

US 2004/0169708 A1 Sep. 2, 2004

(30) Foreign Application Priority Data

Dec. 13, 2002 (JP) ..... 2002-362963
Jul. 31, 2003 (JP) ..... 2003-205103

(51) Int. Cl.
*B41J 2/175* (2006.01)

(52) U.S. Cl. ..... 347/86

(58) Field of Classification Search ..... 347/84, 347/85, 86, 87; 277/389; 137/535, 857, 137/881

See application file for complete search history.

(56) References Cited

U.S. PATENT DOCUMENTS 6,585,358 B1 * 7/2003 Usui et al. ..... 347/85
6,666,551 B1 * 12/2003 Kobayashi et al. ..... 347/86
6,837,575 B1 * 1/2005 Usui ..... 347/85

FOREIGN PATENT DOCUMENTS

| | | | |
|---|---|---|---|
| EP | 1 258 359 | A1 | 11/2002 |
| JP | 11-170558 | A | 6/1999 |
| JP | 2002-2-5413 | A | 7/2002 |
| JP | 2002-205413 | A | 7/2002 |
| WO | WO-03/093019 | A | 11/2003 |

OTHER PUBLICATIONS

European Search Report (Mar. 22, 2004).
extended European Search Report in Appln. EP 05 02 4675.0 (Feb. 6, 2006).

* cited by examiner

*Primary Examiner*—Anh T. N. Vo
(74) *Attorney, Agent, or Firm*—Stroock & Stroock & Lavan LLP

(57) ABSTRACT

In a liquid cartridge, a surface of a valve lid side of a valve member communicates with a liquid supplying part, a surface of a first part of a wall face side of a liquid containing section communicates with the liquid containing section, in regard to the valve member, and a surface of a second part communicates with the liquid supplying part, and if the pressure of the liquid supplying part is smaller than the pressure of the liquid containing section, the valve member is pressed to the valve lid side, the liquid containing section and the liquid supplying part communicate with each other over the first and second parts of the valve member, the valve member is formed of a material softer than the wall face of the liquid containing section, and a projection is provided on a surface being in contact with the valve member in regard to the wall face of the liquid containing section along an outer circumference surrounding the first and second parts of the valve member, being in pressure contact with the valve member.

24 Claims, 16 Drawing Sheets

PRESSURE DIFFERENTIAL REGULATING VALVE UNIT, A LIQUID CARTRIDGE AND A METHOD FOR ASSEMBLING A LIQUID CARTRIDGE

This patent application claims priority from Japanese patent applications Nos. 2002-362963 filed on Dec. 13, 2002 and 2003-205103 filed on Jul. 31, 2003, the contents of which are incorporated herein by reference.

BACKGROUND OF THE INVENTION

1. Field of the Invention

The present invention relates to a pressure-difference regulating valve unit, a liquid cartridge and a method for assembling a liquid cartridge. More particularly, the present invention relates to a pressure-difference regulating valve unit, a liquid cartridge and a method for assembling a liquid cartridge, wherein the liquid cartridge supplies a liquid to a liquid ejecting apparatus when mounted on the liquid ejecting apparatus.

2. Description of the Related Art

In an inkjet type recording apparatus, ink is supplied to a recording head while mounting an ink cartridge containing the ink on a holder of an inkjet type recording apparatus. Here, the ink, the inkjet type recording apparatus and the ink cartridge are an example of the liquid, the liquid ejecting apparatus and liquid cartridge respectively.

The ink cartridge is provided with, for example, an ink accommodating section for containing the ink, a valve member that operates based on the pressure difference between the ink accommodating section side and the recording head side and an atmospheric valve for connecting the ink accommodating section with the atmosphere. This ink cartridge is mounted on a holder of an inkjet type recording apparatus, and thus the atmospheric valve allows the ink accommodating section to be connected with the atmosphere. Further, in the state where the ink cartridge is mounted on the holder, the pressure difference occurs in the valve member because the recording head consumes the ink, so that a center part of the valve member is elastically deformed by the pressure difference, and thus the ink is supplied to the recording head from the ink accommodating section as disclosed in Japanese Patent Application Publication No. 1999-170558.

In the ink cartridge above, the valve member has a peripheral edge part with the difficulty to be elastically deformed in contrast to the center part, and the peripheral edge part is fixed to the ink cartridge by ultrasonic welding. Therefore, there was a problem that the dust caused by ultrasonic welding was mixed into the ink.

SUMMARY OF THE INVENTION

Therefore, it is an object of the present invention to provide a pressure-difference regulating valve unit, a liquid cartridge and a method for assembling a liquid cartridge, which is capable of overcoming the above drawbacks accompanying the conventional art. The above and other objects can be achieved by combinations described in the independent claims. The dependent claims define further advantageous and exemplary combinations of the present invention.

According to the first aspect of the present invention, a liquid cartridge comprises a liquid containing section for containing a liquid, a cartridge body which comprises a liquid supplying part for supplying a liquid in the liquid containing section outside, a valve member contained in a concave part formed at the cartridge body to be opened when a pressure difference between the liquid containing section and the liquid supplying part occurs and a valve lid for holding the valve member while fitting into the concave part and besides pressing an outer circumference of the valve member toward a wall face in the concave part, wherein a projection is formed on a surface, with which the valve member is in contact, of the wall face of the concave part to be in pressure contact with the valve member along the outer circumference of the valve member.

Thus, since the projection of the wall face in the concave part is in pressure contact with the valve member so that the valve member is attached to the cartridge body, it is possible to attach the valve member easily by the valve member and the projection without ultrasonic welding. In addition, since the ultrasonic welding is not needed, the dust resulting from that does not occur, so that it is not necessary to clean the dust and it is possible to prevent the dust from being mixed into the ink.

In the liquid cartridge above, the valve lid may include a valve member contact part provided to face the projection holding the valve member for pressing the valve member toward the projection while being in contact with the valve member.

Thus, the contact part can attach the valve member to the projection securely.

The liquid cartridge above may further include a seal member for sealing to urge an outer surface opposite to a surface, on which the valve member is provided, of the valve lid and a wall face of the cartridge body around the outer surface of the valve lid toward a direction in which the valve lid is in contact with the projection, wherein the concave part is formed on the wall face of the cartridge body.

Thus, since the seal member attaches the valve lid to the wall face side, the valve lid is attached to the wall face more securely, and it is possible to improve the liquid tight property between the projection and the valve member.

In the liquid cartridge above, the valve member may be formed of an elastic material, and the projection is in pressure contact, deforming the valve member. Thus, it is possible to attach the valve member easily by the valve member and the projection securely without ultrasonic welding.

According to the second aspect of the present invention, a pressure-difference regulating valve unit, which comprises a liquid containing section for containing a liquid and a valve member contained in a cartridge body comprising a liquid supplying part for supplying a liquid in the liquid containing section outside, to be opened when a pressure difference between the liquid containing section and the liquid supplying part occurs, comprises a valve lid which comprises the valve member comprising a peripheral edge part of a cylindrical shape elastically deformable based on the pressure difference and a valve member holding part of a substantially cylindrical shape for fixing the peripheral edge part by inserting into the peripheral edge part of the valve member and an urging member provided between the valve member and the valve lid for urging the valve member toward a direction being distanced from the valve lid.

Thus, since the valve member and the urging member are held in the valve lid so that the pressure-difference regulating valve unit is formed, it is easy to position them each other. In addition, since the urging member is held between the valve member and the valve lid, a fixture for attaching the urging member to the liquid cartridge is not needed. Therefore, it is possible to assemble the liquid cartridge easily.

In the pressure-difference regulating valve unit, the valve lid may further include a wall surface contact part of a substantially cylindrical shape, of which an inner diameter is larger than an outer diameter of the peripheral edge part of the valve member, surrounding the valve member holding part, being in contact with a wall face of a concave part formed at the cartridge body to which the valve lid is attached.

Thus, the valve member is securely held on the wall face of the concave part. Further, since the valve lid and the cartridge body are positioned, it is also possible to position the valve member to the cartridge body with high accuracy.

In the pressure-difference regulating valve unit, the urging member may be a coil spring, the valve lid may include a spring fitting part of a cylindrical shape, of which an inner diameter is substantially the same as an outer diameter of the coil spring, projecting to face the valve member at a position on which the coil spring is in contact, and the coil spring may be held in the valve lid while fitting into the spring fitting part.

Thus, the coil spring is positioned to the valve lid accurately, so that it is possible to urging the valve member securely.

In the pressure-difference regulating valve unit, the spring fitting part may have a notch enabling a liquid to flow into and/or out of the spring fitting part, even though the valve member is attached to the spring fitting part.

Thus, if the liquid passage is in the spring fitting part, it is possible to prevent the passage in the spring fitting part from closing, even though the valve member is moved toward the valve lid by the pressure difference to attach the valve member to the spring fitting part.

In the pressure-difference regulating valve unit, the spring fitting part may have a plurality of notches cut in from the valve member, and at least one of lengths of a plurality of projecting pieces in a surface direction formed by the plurality of notches maybe larger than an inner diameter of the coil spring.

Thus, if the coil spring is attached to the spring fitting part of the valve lid, it is possible to prevent the spring fitting part from getting into the coil spring be mistake.

In the pressure-difference regulating valve unit, the urging member may be a coil spring, the valve member may include a valve lid side projecting part of a substantially cylindrical shape, of which at least a part of an outer diameter is larger than an inner diameter of the coil spring, projecting to face the valve lid at a position on which the coil spring is in contact, and the coil spring may be held in the valve member by inserting the valve lid side projecting part into the coil spring.

Thus, it is possible to hold the coil spring to be positioned to the valve member accurately.

In the pressure-difference regulating valve unit, the urging member may be a coil spring, the valve member may include a valve lid side projecting part of a substantially cylindrical shape, of which at least a part of an outer diameter is larger than an inner diameter of the coil spring, projecting to face the valve lid at a position on which the coil spring is in contact, and the coil spring may be held in the valve lid while fitting into the valve lid side cylinder part.

Thus, it is possible to hold the coil spring to be positioned to the valve member accurately.

In the pressure-difference regulating valve unit, the valve member may include a seal part provided to project toward an opposite side to the urging member corresponding to a position at which the valve member is urged by the urging member, for preventing the liquid containing section and the liquid supplying part from communicating with each other by being urged by the urging member toward a wall face side of a concave part formed at the cartridge body.

Thus, the seal part can prevent the liquid containing section and the liquid supplying part from communicating with each other by receiving the urging force from the urging member directly.

According to the third aspect of the present invention, a method for manufacturing a liquid cartridge, which includes a liquid containing section for containing a liquid, a cartridge body including a liquid supplying part for supplying the liquid in the liquid containing section outside and a pressure-difference regulating valve unit including a valve member contained in the cartridge body to be opened when a pressure difference between the liquid containing section and the liquid supplying part occurs, includes the steps of preparing the cartridge body comprising the liquid containing section and a pressure-difference regulating valve unit containing section, which is a concave part formed at the cartridge body, communicating with the liquid containing section, forming a pressure-difference regulating valve unit by putting an urging member, which urges the valve member toward a direction being distanced from the valve lid, between the valve member comprising a peripheral edge part, of which a peripheral edge is cylindrical in shape, elastically deformable based on the pressure difference and a valve lid comprising a valve member holding part of a substantially cylindrical shape for fixing the peripheral edge part by inserting into the peripheral edge part of the valve member and attaching the pressure-difference regulating valve unit to the pressure-difference regulating valve unit containing section.

Thus, the valve member, the urging member and the valve lid are assembled as the pressure-difference regulating valve unit, and then the pressure-difference regulating valve unit is attached to the liquid cartridge. Therefore, since the urging member is held between the valve member and the valve lid, a fixture for attaching the urging member to the liquid cartridge is not needed. Therefore, it is possible to assemble the liquid cartridge easily.

The method for manufacturing a liquid cartridge may further include a step of sealing by a sealing member to cover an outer surface opposite to a surface, on which the valve member is provided, of the valve lid and a wall face of the cartridge body around the outer surface of the valve lid toward a direction in which the valve lid is in contact with the projection, wherein the concave part is formed on the wall face of the cartridge body.

Thus, since the seal member pushes the valve lid toward the wall face of the concave part, the valve lid is attached securely.

The attaching step may include a step of forcing a projection to be in pressure contact with the valve member, wherein the projection maybe provided along an outer circumference of the valve member on a wall face with which the valve member of the pressure-difference regulating valve unit containing section is in contact.

Thus, since the projection of the wall face, with which the valve member of the pressure-difference regulating valve unit containing section is in contact, is in pressure contact with the valve member so that the valve member is attached to the cartridge body, it is unnecessary to attach the valve member by ultrasonic welding. Therefore, the dust caused by the ultrasonic welding does not occur, and it is possible to prevent the dust from being mixed into the ink.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
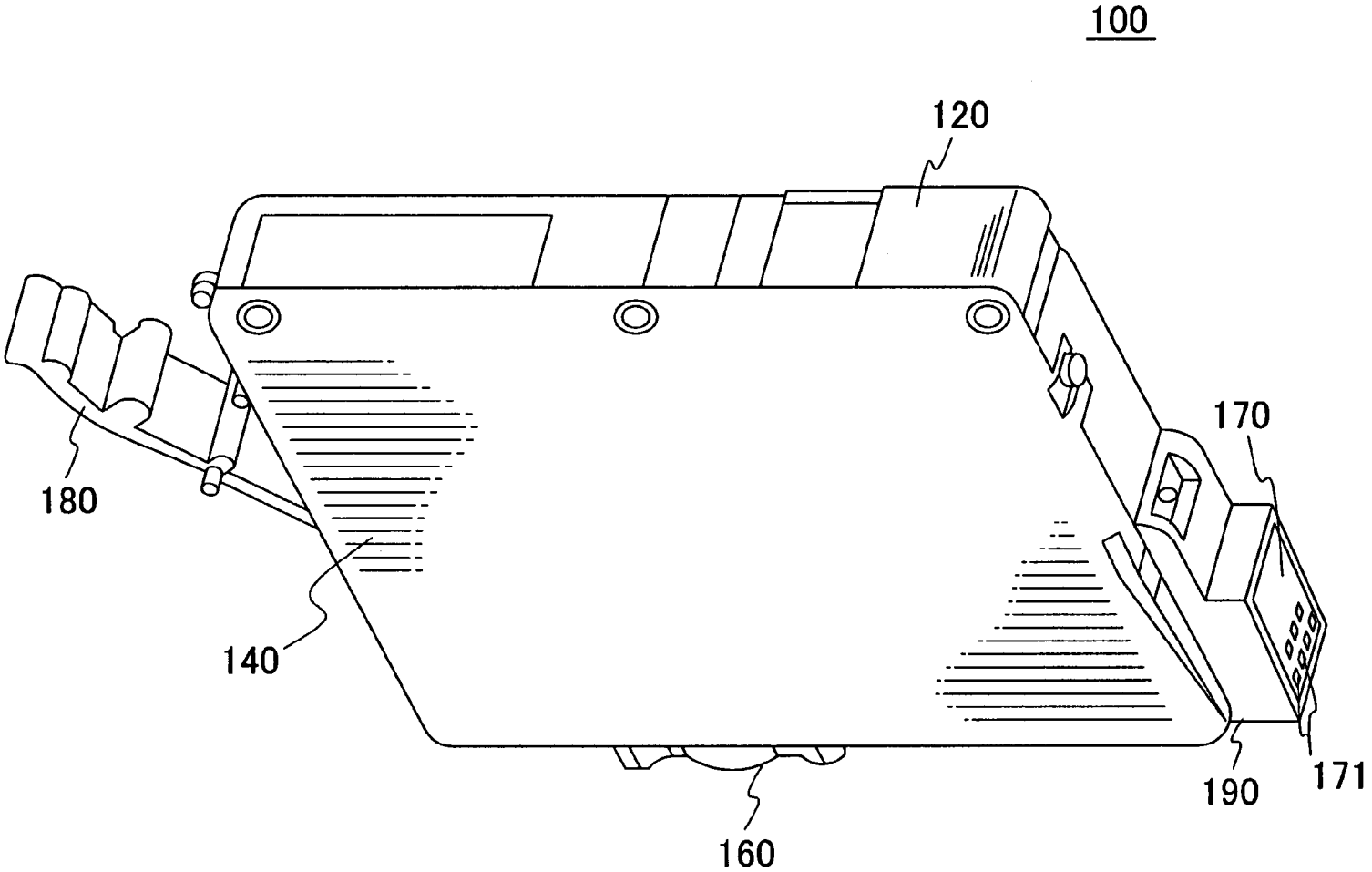
FIG. 1 is a front perspective view of an ink cartridge.

FIG. 1 is a front perspective view of the structure of the ink cartridge 100 used for an inkjet type recording apparatus, which is adapted for an example of a liquid cartridge suitable for supplying a liquid to a liquid ejecting head of a liquid ejecting apparatus, obliquely viewed from an upper position.

In addition, the liquid ejecting apparatus of the present invention is not limited to the liquid ejecting head of the liquid ejecting apparatus, and it includes a color material ejecting head of the color filter manufacturing apparatus for manufacturing color filters of a liquid crystal display, an electrode material (conduction paste) ejecting head for forming electrodes such as an organic EL display or a FED (Field Emission Display) and further a bio organism ejecting head of the biochip manufacturing apparatus and a sample ejecting head as a minute pipette for manufacturing biochips.

Figure 2:
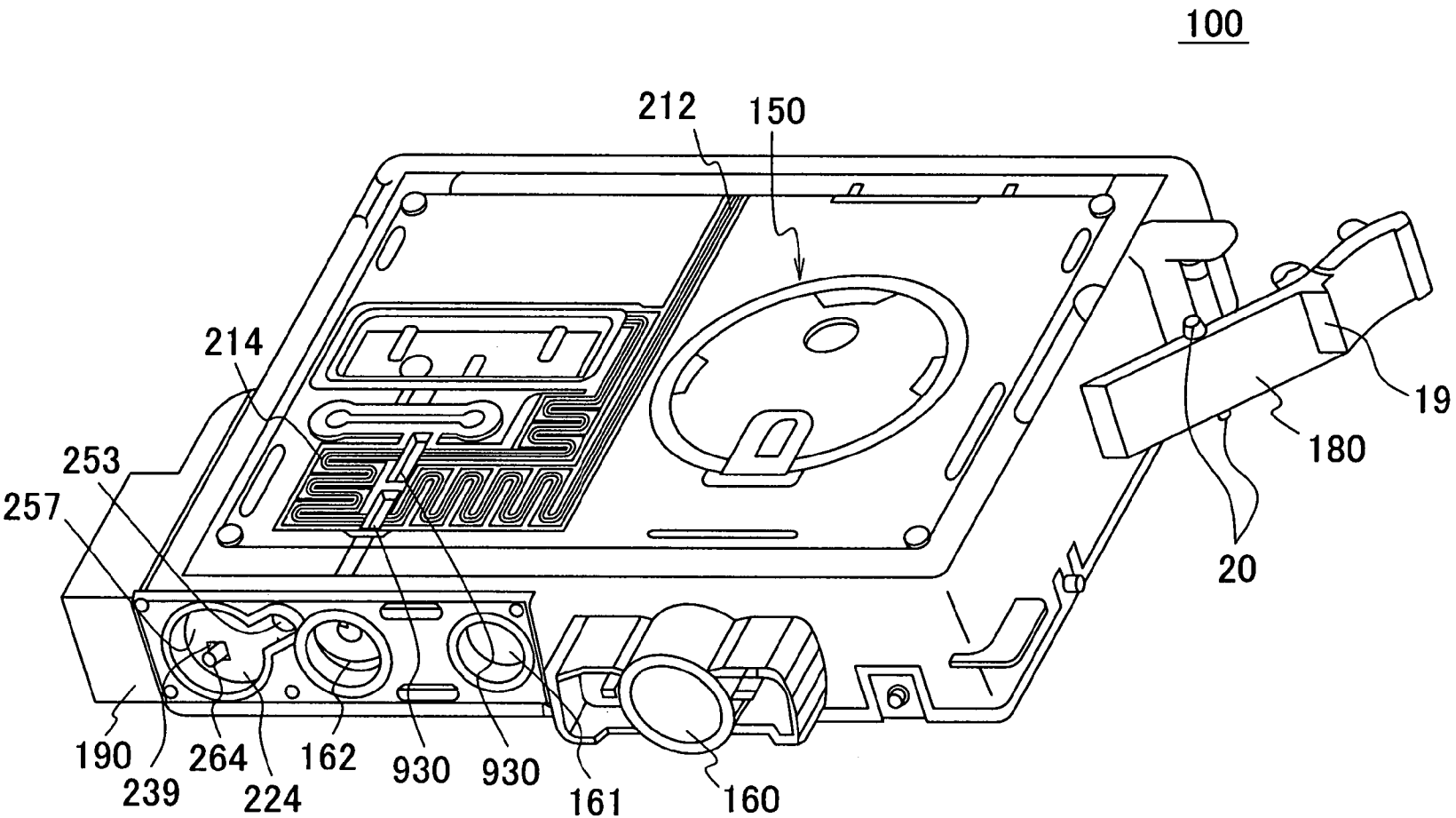
FIG. 2 is a rear perspective view of an ink cartridge before a film is attached.
Figure 3:
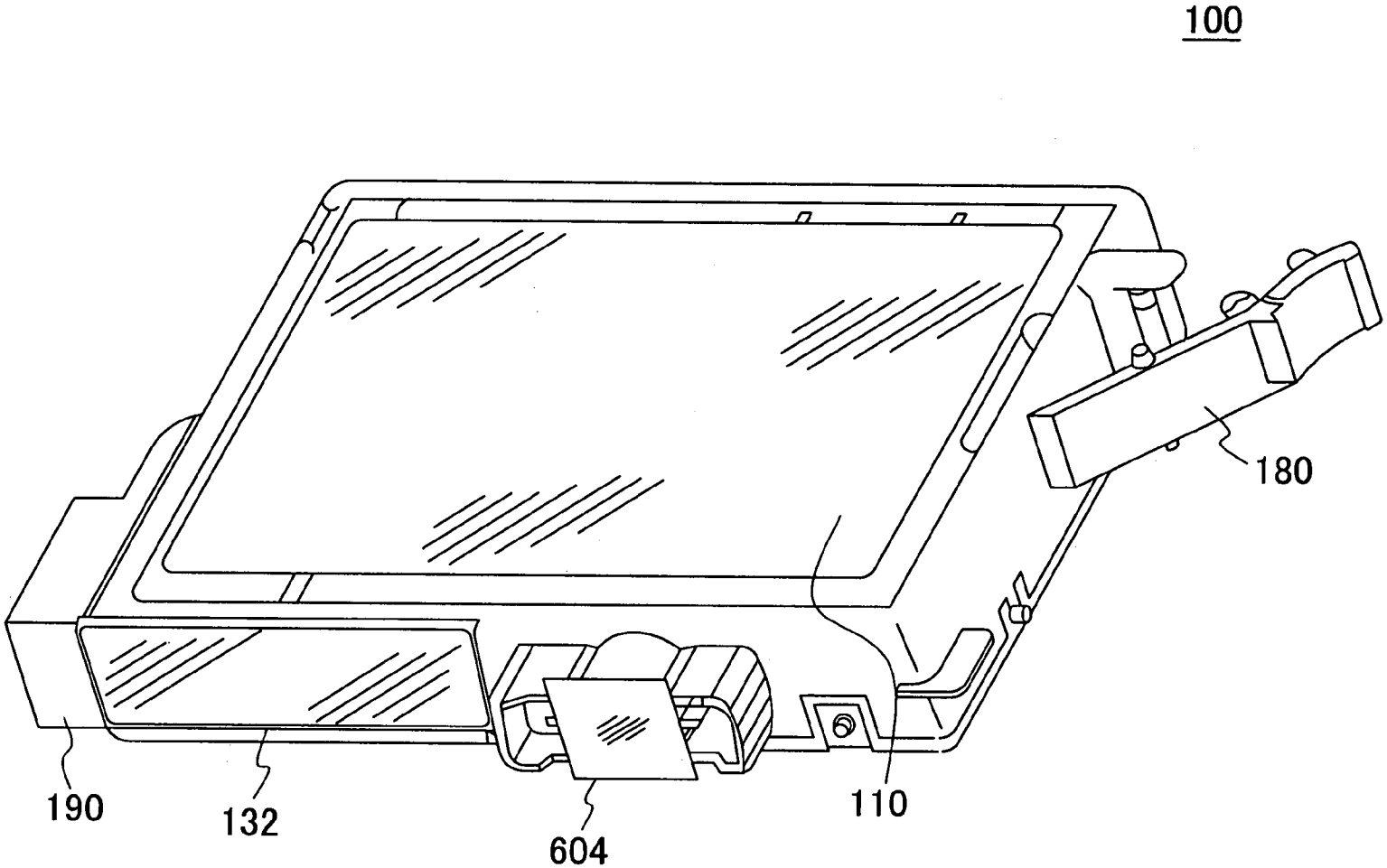
FIG. 3 is a rear perspective view of an ink cartridge after a film is attached.
Figure 4:
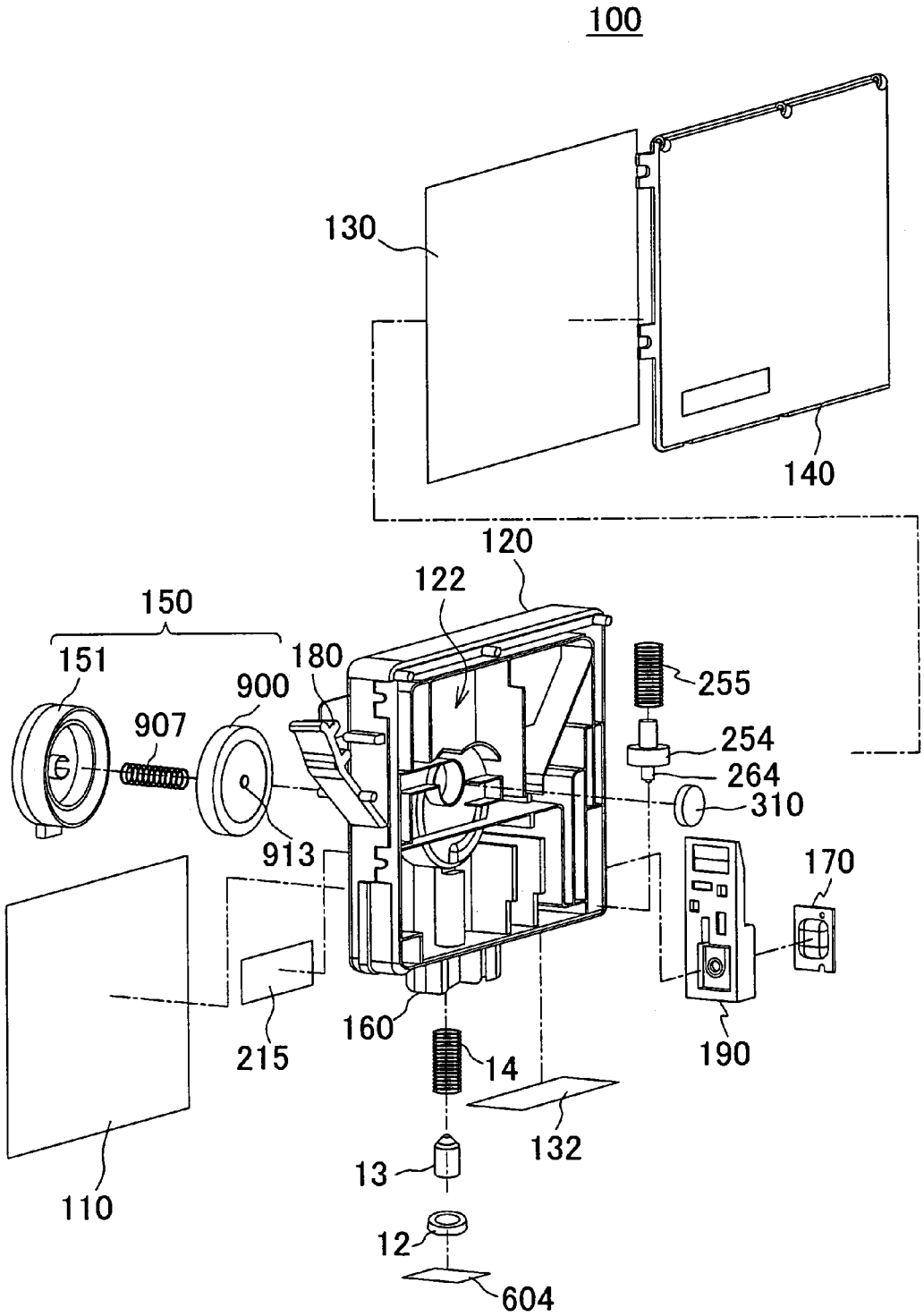
FIG. 4 is an exploded perspective view of an ink cartridge.
Figure 5:
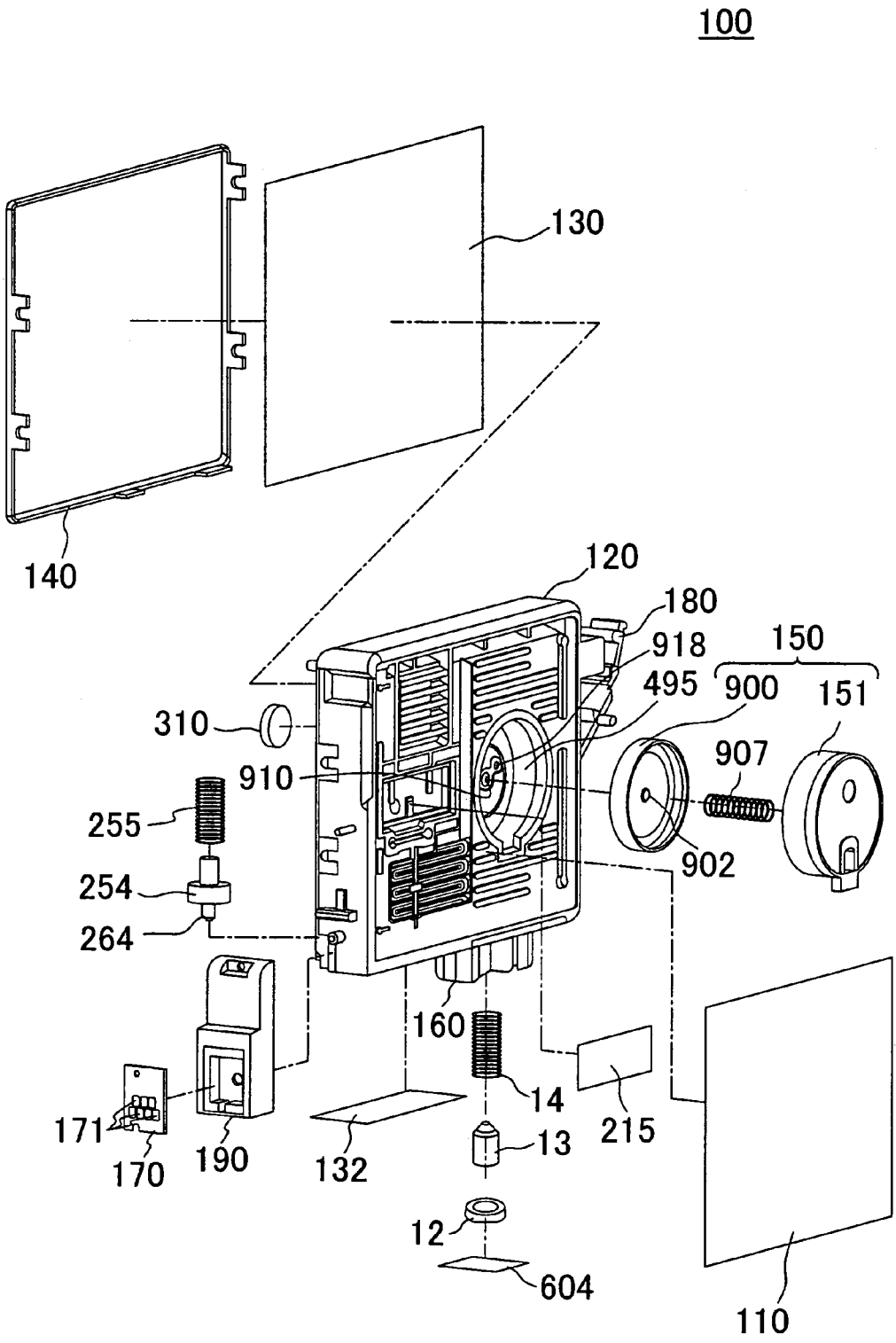
FIG. 5 is an exploded perspective view of an ink cartridge.
Figure 6:
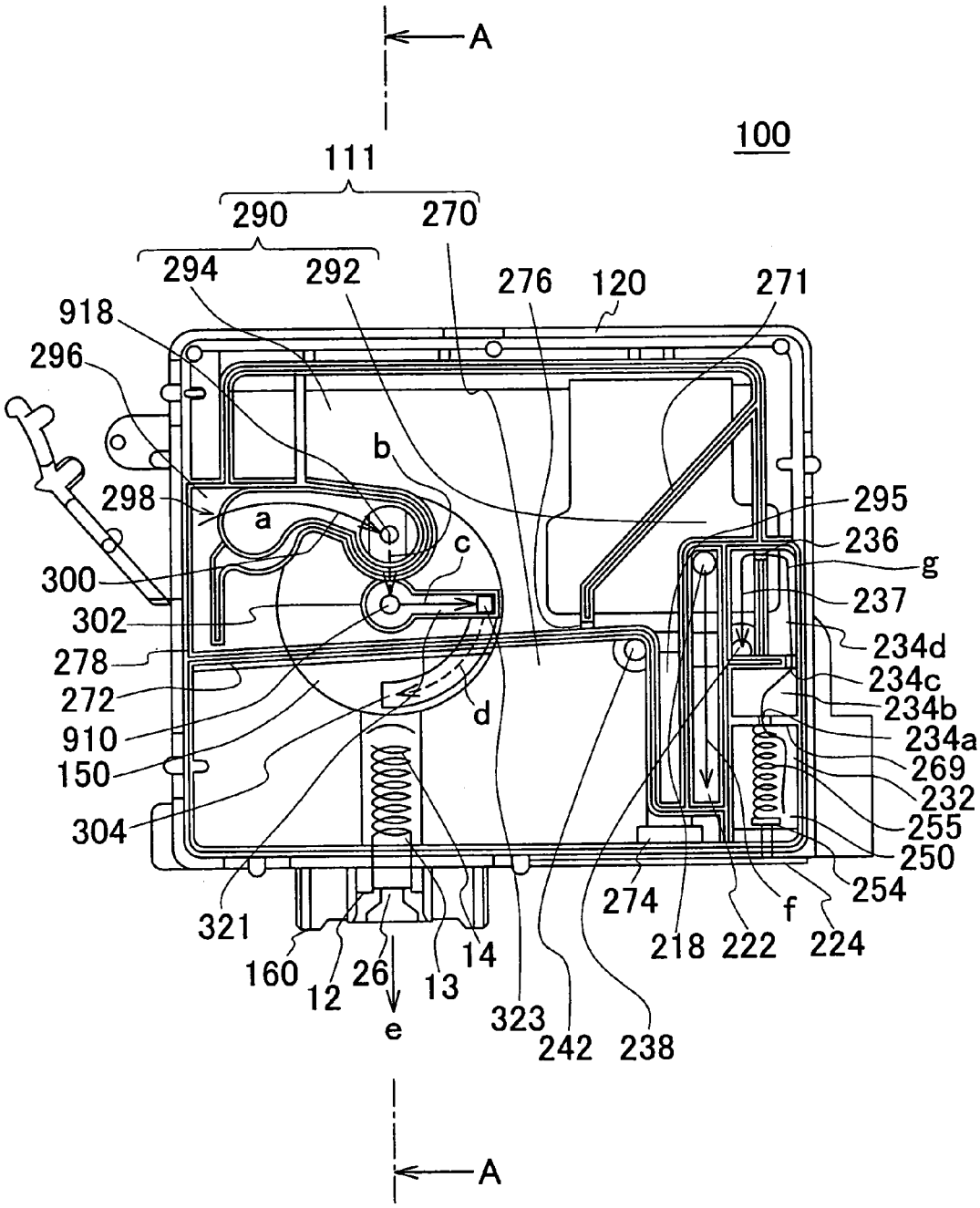
FIG. 6 is a front view of an ink cartridge in a state before a film is attached.
Figure 7:
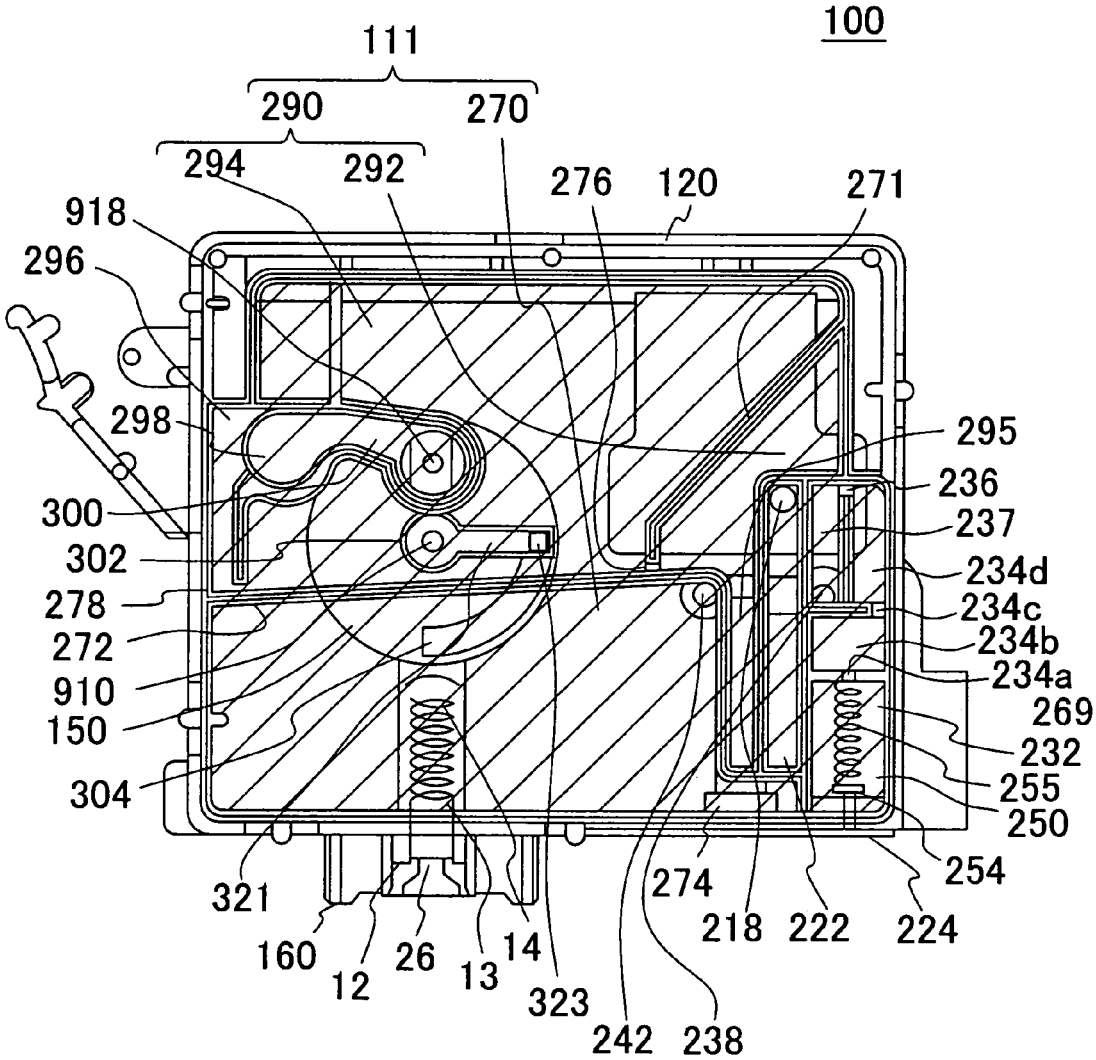
FIG. 7 is a front view of an ink cartridge in a state after a film is attached.

FIG. 2 and FIG. 3 are rear perspective views the ink cartridge 100 in FIG. 1 obliquely view ed from a lower position, FIG. 2 shows the ink cartridge 100 in a state a film 110 is not attached thereto and FIG. 3 shows the ink cartridge 100 in a state the film 110 is attached thereto. Further, FIG. 4 and FIG. 5 are perspective views showing the ink cartridge 100 wherein members of which the ink cartridge 100 consist is exploded. FIG. 6 and FIG. 7 are front views of the ink cartridge 100 in FIG. 1, FIG. 6 shows the ink cartridge 100 in a state before a film 130 is attached to an opening part 122 of the ink cartridge 100 and FIG. 7 shows the ink cartridge 100 in a state in which a film 130 is attached to an opening part 122 of the ink cartridge 100. In addition, the film 130 is attached to an area, which is shown with hatching in FIG. 7.

As shown in FIG. 4, the ink cartridge 100 has a cartridge body (container body) 120 having a shape of an approximate case with the opening part 122, the film 130, which covers almost all face of the opening part 122 and a lid 140, which covers the outside of the film 130. The internal part of the cartridge body 120 is partitioned by ribs or walls as described below. The film 130 seals almost all face of the opening part 122 of the cartridge body 120 in order that the internal part of it comes into a closed state. The lid 140 is further fixed to the cartridge body 120 in order to wrap the outside of the film 130 in a non-closed state.

The cartridge body 120 has an ink accommodating section 111 for containing ink, an ink channel part from the ink accommodating section 111 to an ink supplying part 160, an ink side passage, which allows the ink accommodating section 111 to communicate with the atmosphere, the atmospheric valve containing section and an atmosphere communicating part, which consists of an atmosphere passage, and it is made of, for example, Polypropylene (PP) in a unified body.

The ink cartridge 100 further has an ink supply controlling means 150, a memory 170 and an engaging lever 180. The ink supplying part 160 supplies ink, which is contained in the ink accommodating section 111, to the recording head of the inkjet type recording apparatus through an ink supply needle of the apparatus which needle is inserted into an opening of said ink supplying part 160. The ink supply needle faces the lower face of the cartridge body 120 and is formed on the carriage 42 mounting thereon the ink cartridge 100. The memory 170 is caulked into an attaching part 190 and the attaching part is caulked and attached to the lower part of the side face of the cartridge body 120. The memory 170 stores the information on the kind of the ink cartridge 100, the information on the color held by the ink cartridge 100 and the information on the present amount of remaining ink etc., and it transfers this information by a plurality of terminals 171, which are exposed thereon, between the apparatus body and the ink cartridge 100. The engaging lever 180 is formed at the upper part of the side face opposite to the attaching part 190 in regard to the cartridge body 120, and is engaged with the holder of the inkjet type recording apparatus.

An ink supply controlling means 150 consists of a pressure-difference valve, which supplies ink of the ink accommodating section 111 to the ink supplying part 160 by pressure difference between ink accommodating section 111 and the ink supplying part 160 that occurs accompanying the consummation of ink. The ink supply controlling means has a membrane valve 900, which is an example of a valve member inserted into a pressure-difference regulating valve unit containing section 495 of the cartridge body 120, capable of elastic deformation, a valve lid 151 which covers the pressure-difference regulating valve unit containing section 495, a coil spring 907 which is an example of an urging member arranged between the membrane valve 900 and the valve lid 151. This membrane valve 900, the valve lid 151 and the coil spring 907 are an example of the pressure-difference regulating valve unit constituting the ink supply controlling means 150 of the present invention. The method of assembling the pressure-difference regulating valve unit and its operation will be described below.

The ink accommodating section 111 is divided by a wall 272 mainly into a upper part and a lower part, which extends in a horizontal direction, as shown in FIG. 6 and FIG. 7, and an atmospheric side accommodating chamber 270, which can communicate with the ambient air through a communicating hole 242, is formed in the lower part, while a liquid-supply side accommodating chamber, which consists of a first ink accommodating section 292 and a second ink accommodating section 294 and is blocked from the ambient air, is formed in the upper part. The liquid-supply side accommodating chamber 290 is divided by a slope wall 271 having a communicating part 276 near the wall 272 (at the lower part area) into the first and second ink accommodating sections 292 and 294, and is provided with a channel part 296, which is arranged in order to surround the circumference of the second ink accommodating section 294. The channel part 296 is coupled with the second ink accommodating section 294 via a communicating part 278 at the lower part, and besides is coupled with the ink supply controlling means 150 via passages 298 and 300 and a passage hole 918.

Moreover, the lower flow side of the ink supply controlling means 150 is configured to communicate with the ink supplying part 160 via a passage hole 910 which communicates with the ink supply controlling means 150, a communicating part 302 and a channel 321 which communicate with the passage hole 910, a passage hole 323 which is formed at an end of the channel 321 and is formed to face the front face side and a communicating part 304 of which an end communicates with the passage hole 323.

The atmospheric side accommodating chamber 270 and the first ink accommodating section 292 communicate with each other by a communicating passage 295 which extends vertically, and are configured in order that the ink in the atmospheric side accommodating chamber 270 is sucked up into the first ink accommodating section 292 corresponding to the consummation of ink from the ink supplying part 160 and then flows into the ink supply controlling means 150 via the second ink accommodating section 294 and the channel part 296 etc. The ink is flowed into the ink supply controlling means 150 from the atmospheric side accommodating chamber 270 of the ink accommodating section 111 through a sequence of the communicating part 274, a second ink inlet 162, a communicating passage 295, the communicating parts 276 and 278, the channel part 296, the passages 298 and 300 and the passage hole 918.

Meanwhile, the atmospheric valve part 250 has a hollow part 232, which is an atmospheric valve containing section, for containing an atmospheric valve 254, and has a communicating hole 239, also serving as a atmosphere communicating channel, of which the diameter is a little larger than that of a shaft part 264 of the atmospheric valve 254, on the wall face of a lower position of the hollow part 232, so that the shaft part 264 of the atmospheric valve 254 is always urged towards the bottom face of the ink cartridge 100 by a spring 255 and inserted thereto to be able to freely slide, and the communicating hole 239 is sealed by the atmospheric valve 254 when the ink cartridge 100 is not mounted onto the holder of the inkjet type recording apparatus.

Figure 8:
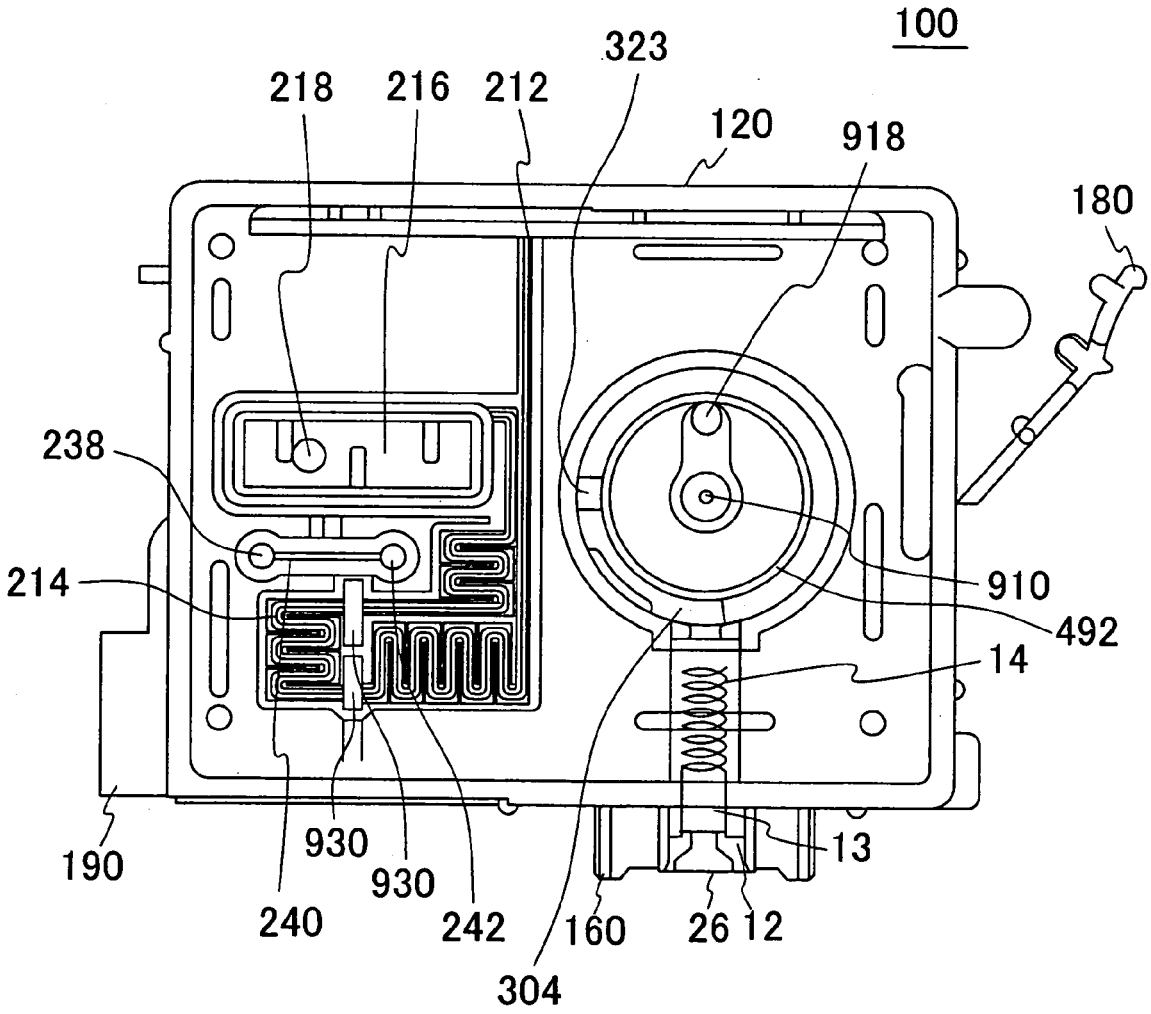
FIG. 8 is a rear view of an ink cartridge in a state before a film is attached.

FIG. 8 is a rear view showing the ink cartridge 100 of FIG. 1 in a state before the film 110 is attached thereto. The atmosphere side passage, which communicates with the ambient air taking the communicating hole 239 described above as a boundary, consists of an opening 212, a passage 214 which is circuitous or winding, a filter containing section 216, a communicating hole 218, a communicating part 222 and a communicating hole 253 and a communicating part 224 which are formed on the bottom face of the communicating part 222.

Particularly, as shown in FIG. 8, an end of one passage 214, which is formed on the front face of the cartridge body 120 and winding in the shape of amaze, is opened with the atmosphere by the opening 212, and the other end is coupled with the filter containing section 216 for containing the filter 215 (FIG. 4 and FIG. 5) having a function of ink repellency and air permeability. The filter container part 216 communicates with the communicating hole 218, which penetrates from the front side to the rear side of the cartridge body 120. The communicating hole 218 is coupled with the communicating part 224 via the communicating part 222 and the communicating hole 253, which is formed on the bottom part of a room that partitions the communicating part 222, in the rear side of the cartridge body 120. In the middle of the passage 214, a chamber 930, which consists of a concave part, is provided.

As shown in FIG. 2, the communicating part 224 is formed as a concave part 257 on the bottom face of the cartridge body 120, and a shaft part 264, which is an operating rod of the atmospheric valve 254, is exposed, while the communicating hole 239 capable of communicating with the hollow part 232, which contains the atmospheric valve 254, and the communicating hole 253, which communicates with the communicating part 222, are formed inside the concave part 257, and the external face of the concave part 257 is sealed by the film 132 for sealing the first and second ink inlets 161 and 162. A thing, which can perform elastic deformation by a pressing force of a projection protruding from the holder, is chosen for this film 132.

Meanwhile, as shown in FIG. 6, the ink side passage, which communicates with the atmospheric side accommodating chamber 270 taking the communicating hole 239 described above as a boundary, consists of an hollow part 232, a passage hole **234*a*, a communicating chamber 234*b*, a communicating part 234*c*, a communicating chamber 234*d*, a communicating part 236, a communicating chamber 237 and a communicating hole 238, a communicating groove 240 and a communicating hole 242. Particularly, the passage hole 234*a* is formed on a wall of upper part of the hollow part 232, and the atmosphere passage is formed to communicate in the following sequence: the communicating chamber 234*b* via the passage hole 234*a*, the communicating part 234*c* formed by a notch on a wall of the upper part of the communicating chamber 234*b*, the communicating chamber 234*d* provided at the upper part of the communicating part 234*c*, the communicating part 236 formed by a notch of a wall of the upper part of the communicating chamber 234*d* and the communicating chamber 237 provided with the communicating hole 238** at a lower position.

The communicating hole 238, which penetrates from the rear side to front side of the cartridge body 120, communicates with the atmospheric side accommodating chamber 270 via the communicating groove 240, which communicates with the communicating hole 238, and the communicating hole 242, which communicates with the communicating groove 240 and also penetrates from the front side to the rear side of the cartridge body 120.

These the atmospheric side accommodating chamber 270, the liquid-supply side accommodating chamber 290, the atmospheric valve part 250 and the atmosphere side passage and the ink side passage become an area which is separated from the atmosphere by attaching the films 130 and 110 to the wall partitioning each of those by thermo welding or fuse-bonding.

The ink supplying part 160 has a seal member 12, which is made of elastomer having an insertion opening 26 into which the ink supply needle provided in the holder is inserted, a supply valve 13, which closes the insertion opening 26 of the seal member 12 and an urging member, which consists of a coil spring etc. that urges the supply valve 13 towards the seal member 12. In addition, a film 604 is attached to the insertion opening 26 of the seal member 12 at the time of factory.

When the ink cartridge 100 is mounted on the holder of the inkjet type recording apparatus, the projecting part provided in the holder pushes up the shaft part 264 of the atmospheric valve upwardly via the film 132 and the ink supply needle of the holder pushes up the supply valve 13 of the ink supplying part 160 upwardly. Due to this, the communicating hole 239 allows the atmosphere channel, extending from the atmospheric valve accommodating section 232 to the communicating hole 242, to communicate with the atmosphere. And, the upper flow than the supply valve 13 in regard to the ink supplying part 160 communicates with the ink supply needle. In addition, if the ink cartridge 100 is mounted on the holder for the first time after the shipment from the factory, the ink supplying needle of the holder gets into the insertion opening 26 by tearing the film 604 attached to the insertion opening 26 of the ink cartridge 100.

When the inkjet type recording apparatus begins to record in a state where the communicating hole 242 communicates with the atmosphere, the recording head is supplied with ink through the ink supply needle from the ink supplying part 160. When ink is supplied from the ink supplying part 160, the ink, which is flowed in a sequence of an arrow a shown in FIG. 6 and the passage hole 918, from the ink accommodating section 111 to the ink supplying part 160, is flowed in a sequence of arrows b, c and d shown in FIG. 6 via the ink supply controlling means 150, is flowed into the ink supplying part 160 and is supplied to the ink supply needle inserted in the ink supplying part 160.

According to this flow of ink, in the ink accommodating section 111, the ink of the atmospheric side accommodating chamber 270 is supplied to the liquid-supply side accommodating chamber 290. The atmosphere accompanying the consummation of ink in the atmospheric side accommodating chamber 270 is flowed into the atmospheric side accommodating chamber 270 from the communicating hole 242 through a route in a sequence of an arrow f in FIG. 6, the communicating part 224 of the bottom face and an arrow g. Although the liquid level of the atmospheric side accommodating chamber 270 goes down because ink is provided to the recording head from the ink supplying part 160, the channel, which is coupled with the atmospheric side accommodating chamber 270 and the liquid-supply side accommodating chamber 290, is provided with a communicating opening at the lowest part of the atmospheric side accommodating chamber 270, so that the atmosphere is not flowed into the liquid-supply side accommodating chamber 290 until all of the ink in the atmospheric side accommodating chamber 270 is moved to the liquid-supply side accommodating chamber.

After the ink in the atmospheric side accommodating chamber 270 is completely consumed, the ink in the first and second ink accommodating sections 292 and 294 of the liquid-supply side accommodating chamber 290 is consumed in that sequence. During that time, due to the surface tension caused by the meniscus of ink formed in the second ink inlet 162, which communicates with the liquid-supply side accommodating chamber 290 and the atmospheric side accommodating chamber 270, the ink in the liquid-supply side accommodating chamber 290 is prevented from being flowed backward to the atmospheric side accommodating chamber 270.

When the ink in the first ink accommodating section 292 begins to be consumed, the air is flowed into the first ink accommodating section 292. Due to this, the liquid level of the first ink accommodating section 292 goes down, but the first and second ink accommodating sections 292 and 294 communicate by the communicating part 276 only at the lower part, so that the ink in the first ink accommodating section 292 is first consumed. When the liquid level reaches the communicating part 276 because the ink in the first ink accommodating section 292 is consumed, the air is flowed into the second ink accommodating section 294 according to the consummation of ink in the second ink accommodating section 294. While the ink in the second ink accommodating section is consumed, the surface tension caused by the meniscus of ink in the communicating part 276 occurs, and therefore the ink in the second ink accommodating section 294 is prevented from being flowed backward to the first ink accommodating section 292.

As described above, although the ink in the atmospheric side accommodating chamber 270 and the first and second ink accommodating sections 292 and 294 is consumed in that sequence, the ink is supplied into the ink supplying part 160 through the passage hole 918 via the passage 300 from the communicating part 278, which is provided near the wall 272 that partitions the ink accommodating section into nearly two parts up and down, even though the liquid level of ink exists in any containing section.

Figure 9:
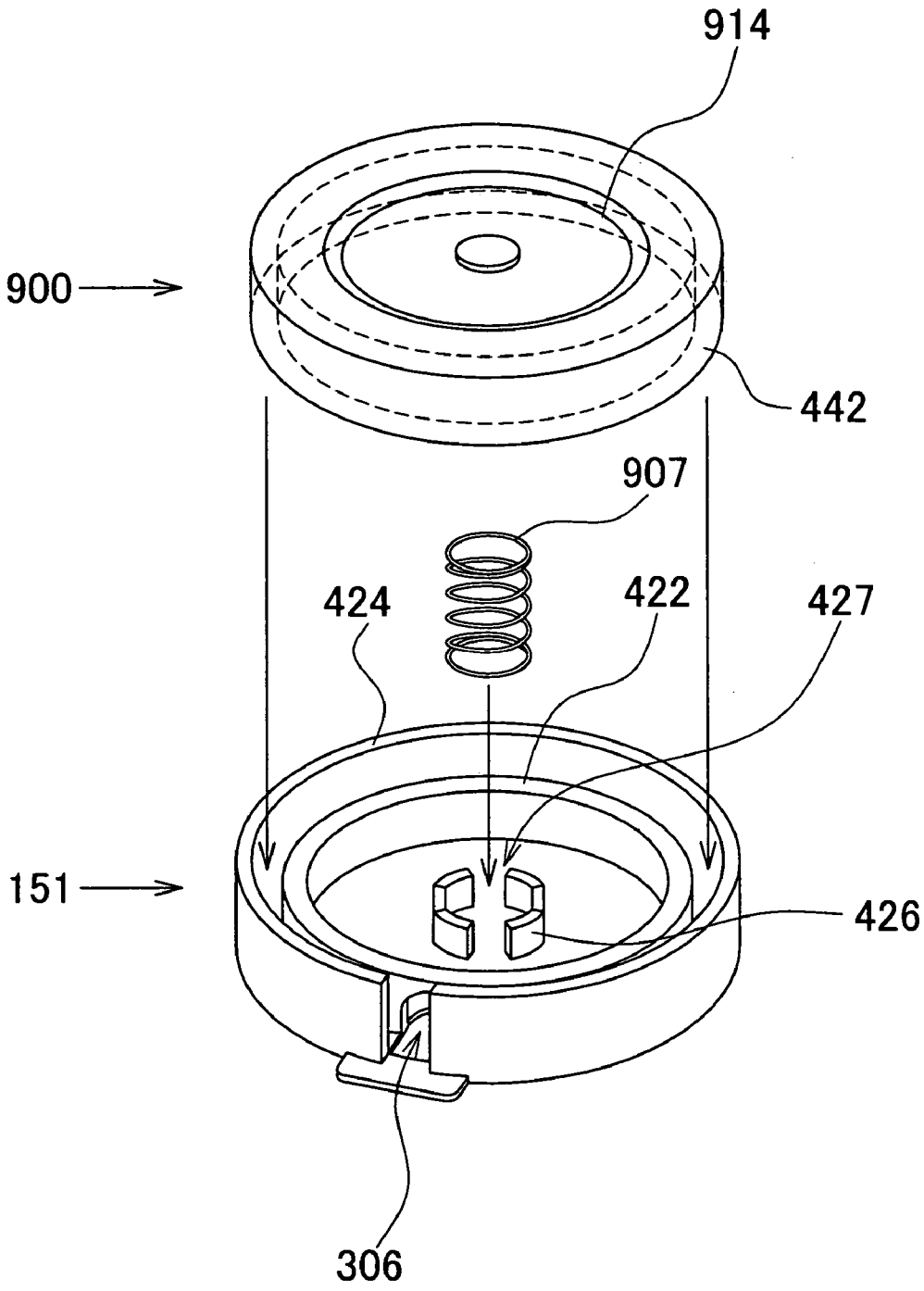
FIG. 9 is an exploded perspective view of an ink supply controlling means.
Figure 10A:
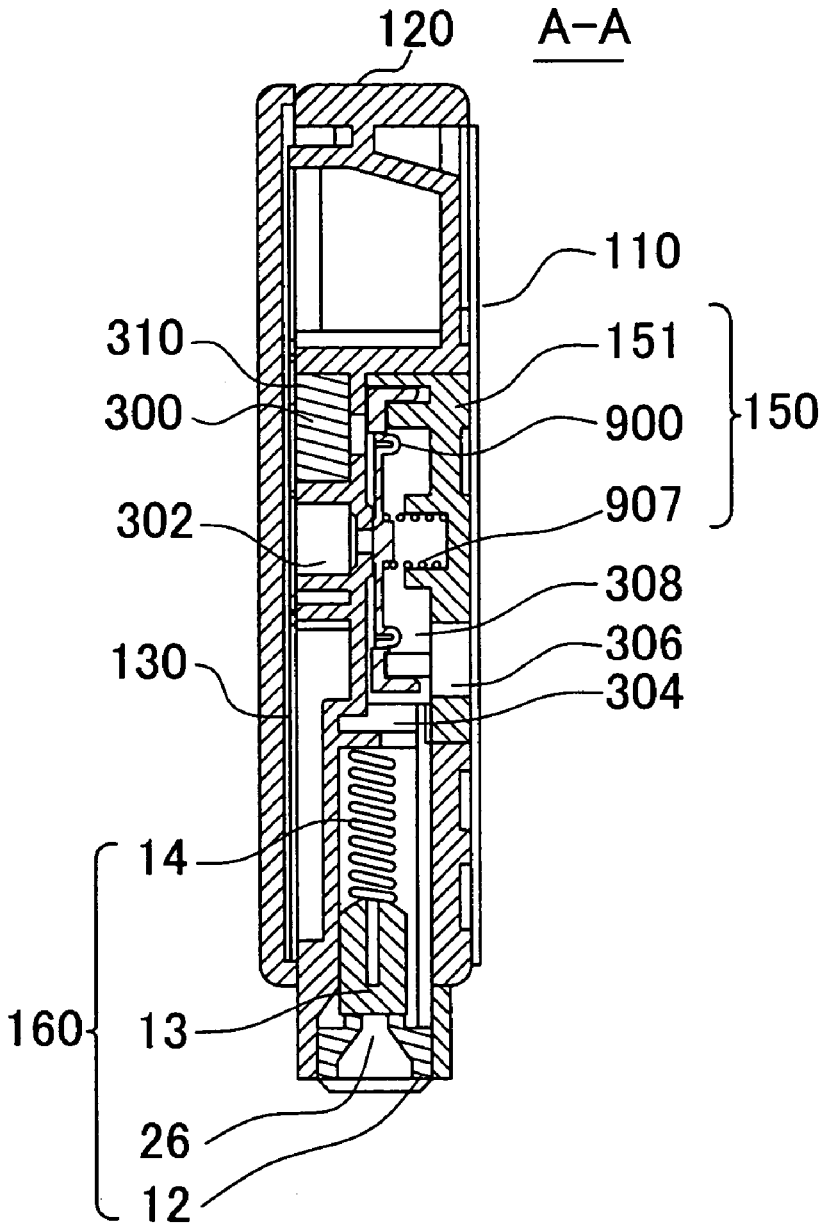
FIG. 10A is a cross-sectional view that shows the A—A section of the ink cartridge.
Figure 10B:
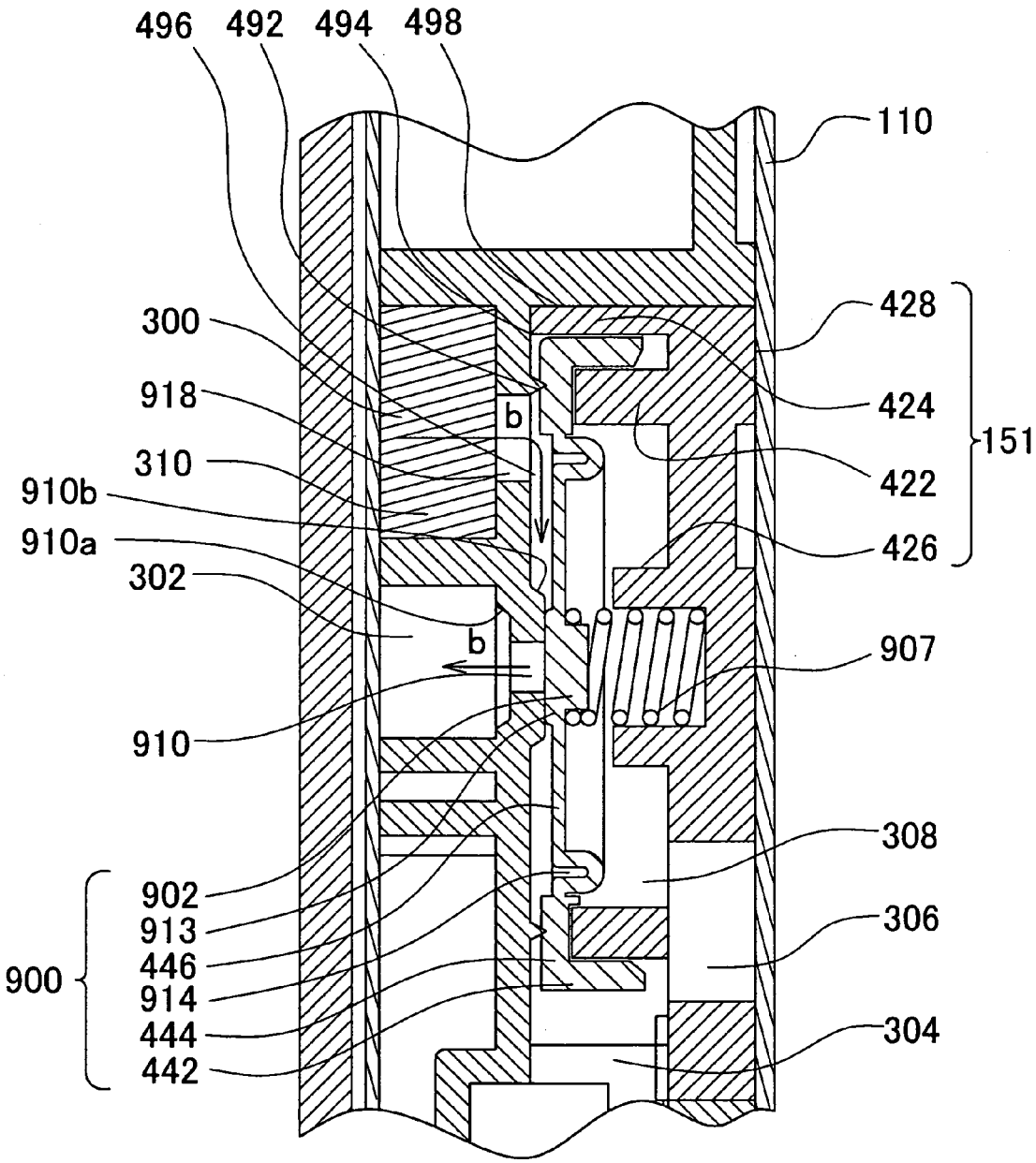
FIG. 10B is an enlarged cross-sectional view near an ink supply controlling means.

FIG. 9 is an exploded perspective view of an ink supply controlling means 150. FIG. 10A is a cross-sectional view that shows the section A—A of the ink cartridge 100 in regard to FIG. 6. FIG. 10B is a partly enlarged cross-sectional view near the ink supply controlling means 150 in FIG. 10A. A membrane valve 900, a coil spring 907 and a valve lid 151, which constitute the ink supply controlling means 150, are assembled to be separated from the cartridge body 120 as a pressure-difference regulating valve unit.

The membrane valve 900 has a peripheral edge part 442 of a cylindrical shape, a thick part 444 provided near the peripheral edge part 442, a body part 446 surrounded by the thick part 444 and elastically deformed, a valve lid side projecting part 902 projecting toward the valve lid 151 at the center of the body part 446, that is, at a position where the coil spring 907 is in contact with the body part 446, a body part side projecting part 913 projecting toward the passage hole 910 of a wall face 494 of a pressure-difference regulating valve unit containing section 495 and a bent part 914. The membrane valve 900 is integrally molded by using a material of elasticity softer than the cartridge body 120 such as elastomer. The valve lid side projecting part 902 is approximately cylindrical in shape, and the outer diameter of the cross-section is slightly larger than the inner diameter of the coil spring 907 in a state before the valve lid side projecting part 902 is assembled to the coil spring 907. Therefore, since the valve lid side projecting part 902 is inserted into an end of the coil spring 907, the coil spring 907 is held to be exactly positioned to the membrane valve 900. More over, only a part of the outer diameter of the cross-section of the valve lid side projecting part 902 may be larger than the inner diameter of the coil spring 907 and other part thereof may be small.

The valve lid 151 has a membrane valve holding part 422, which is an example of a valve member holding part in the shape of an approximate cylinder, a wall face contact part 424 of an approximately cylindrical shape provided around the membrane valve holding part 422 and a spring fitting part 426 projecting toward the membrane valve 900 at the center of the cylinder shape, and is integrally molded by using, e.g., Polypropylene (PP) like the cartridge body 120.

The spring fitting part 426 of the valve lid 151 is approximately cylindrical in shape, and its inner diameter is approximately the same as the outer diameter of the coil spring 907. Therefore, an end of the coil spring 907 is held to be exactly positioned to the valve lid 151. The spring fitting part 426 has a plurality of notches 427 (four in this embodiment shown in FIG. 9) cut in from a side at which the membrane valve 900 is provided. The spring fitting part 426 has the notches 427 enabling the ink to flow between the internal part and the external part, in a state where the membrane valve 900 is opened, if the valve lid side projecting part 902 of the membrane valve 900 is moved and stuck to a position where it gets into the spring fitting part 426 of the valve lid 151, and thus it is possible to prevent the passage inside the spring fitting part 426 from being closed. In addition, the lengths of a plurality of projecting pieces in a surface direction formed by these notches 427 are larger than the inner diameter of the coil spring 907. Therefore, if the coil spring 907 is attached into the spring fitting part 426, it is possible to prevent the projecting pieces of the spring fitting part 426 from being got into the coil spring 907 by mistake.

The outer diameter of an approximately cylindrical shape of the membrane valve holding part 422 in regard to the valve lid 151 is slightly larger than the inner diameter of the peripheral edge part 442 of the membrane valve 900, in a state before the peripheral edge part 442 of the membrane valve 900 is assembled. In addition, the inner diameter of the wall face contact part 424 in regard to the valve lid 151 is larger than the outer diameter of the peripheral edge part 442 of the membrane valve 900. Therefore, in the state where the coil spring 907 is being held between the valve lid 151 and the membrane valve 900, the peripheral edge part 442 of the membrane valve 900 is inserted between the membrane valve holding part 422 and the wall face contact part 424 of the valve lid 151, so that the membrane valve holding part 422 urges the peripheral edge part 442 toward a direction to expand it from the inside, and thus the membrane valve 900 is held in the valve lid 151. In this way, the pressure-difference regulating valve unit is formed. In addition, only a part of the outer diameter of the membrane valve holding part 422 of the valve lid 151 may be larger than the inner diameter of the peripheral edge part 442 and other part may be small, in a state before the peripheral edge part 442 of the membrane valve 900 is assembled into the membrane valve holding part 422.

The valve lid 151 further has the communicating part 306 that penetrates from a position where the membrane valve 900 is attached to a position where the film 110 is attached. Due to this, if the valve lid 151 is attached to the cartridge body 120 along with the membrane valve 900, the membrane valve chamber 308 that consists of the valve lid 151 and the membrane valve 900 communicates with the communicating part 304 and the ink supplying part 160 via the communicating part 306. In addition, the communicating part 304 also communicates with the communicating part 302 provided directly down stream of the passage hole 910.

A circular projection 492 in the shape of a ring is provided on the wall face 494 of the pressure-difference regulating valve unit containing section 495 of the cartridge body 120 along the outer circumference surrounding the passage holes 910 and 918, from the view of the pressure-difference regulating valve unit containing section 495 side (from the right in FIG. 10B). The circular projection 492 is the shape of a wedge that projects toward a direction to which the membrane valve 900 is attached and its cross-section shown in FIG. 10B is sharp toward the direction to which the membrane valve 900 is attached. In addition, the thick part 444 of the membrane valve 900 is softer than the circular projection 492. Therefore, when the pressure-difference regulating valve unit is inserted into the pressure-difference regulating valve unit containing section 495 in a direction from a position closer to the wall face 494 of the pressure-difference regulating valve unit containing section 495 to the membrane valve 900 and the valve lid 151 sequentially, a tip of the circular projection 492 is pressed and cut into the thick part 444 of the membrane valve 900. Due to this, the communicating passage 496 is formed by the wall face 494, the circular projection 492 and the membrane valve 900 to communicate with the passage hole 918.

The circular projection 492 is provided to face the membrane valve holding part 422 of the valve lid 151 holding the thick part 444 of the membrane valve 900. Due to this, the membrane valve holding part 422 of the valve lid 151 is in contact with the thick part 444 and pushes the thick part 444 toward the circular projection 492. The membrane valve 900 seals the surrounding of the communicating passage 496 securely. That is, the membrane valve holding part 422 is also functioning as a valve member contact part in regard to the present invention.

The inner peripheral wall 498 forming the pressure-difference regulating valve unit containing section 495 and the outer circumference of the wall face contact part 424 of the valve lid 151 are approximately the same in shape. In addition, the distance between the membrane valve holding part 422 of the valve lid 151 and the wall face 494 when the wall face contact part 424 of the valve lid 151 is in contact with the wall face 494 is slightly smaller than the sum of the height from the wall face 494 to the tip of the circular projection 492 and the thickness of the thick part 444 of the membrane valve 900. Therefore, the surface 428 outside the valve lid 151 projects slightly more than a wall face of the cartridge body 120 in regard to the surrounding of the valve lid 151.

The film 110 is attached to cover the surface 428 outside the valve lid 151 and a wall face of the cartridge body 120 and to urge a surface of the outside of the valve lid 151. Due to this, the film 110 urges the valve lid 151 toward the pressure-difference regulating valve unit containing section 495. Therefore, the valve lid 151 is attached to the pressure-difference regulating valve unit containing section 495 securely, and it is possible to improve sealing property between the circular projection 492 and the membrane valve 900. In addition, the dust does not occur because it is unnecessary to use ultrasonic welding, and thus it is possible to prevent the dust from being mixed into the ink. And, since the membrane valve 900 is held in the valve lid 151, it is unnecessary to mold the outer circumference part of the membrane valve 900 with two colors to use a material harder than the body part. The passage hole projecting part 910*b* is provided around the passage hole 910 of the cartridge body 120 to project toward the membrane valve 900 and be in contact with the body part side projecting part 913 of the membrane valve 900. Thus, the body part side projecting part 913 of the membrane valve 900 is in contact with the passage hole projecting part 910*b* when the ink is not supplied, so that it is possible to close the passage hole 910 securely.

A filter 310 is provided at the communicating part 300 of the cartridge body 120. The filter 310 filters foreign substances contained in the ink supplied to the inkjet type recording apparatus through the communicating part 300. The filter 310 is provided directly upstream of the ink supply controlling means 150, and thus the ink passing the filter 310 is flowed into the ink supply controlling means 150 directly.

As described above, since the membrane valve 900 and the coil spring 907 are held in the valve lid 151 to form the pressure-difference regulating valve unit, it is not necessary to a use fixture to attach the coil spring 907 to the cartridge body 120 and it is possible to attach it easily. Further, the valve lid 151 and the pressure-difference regulating valve unit containing section 495 are positioned in a state where the membrane valve 900 is held in the valve lid 151, it is also possible to position the membrane valve 900 to the pressure-difference regulating valve unit containing section 495 with more high accuracy.

Figure 11A:
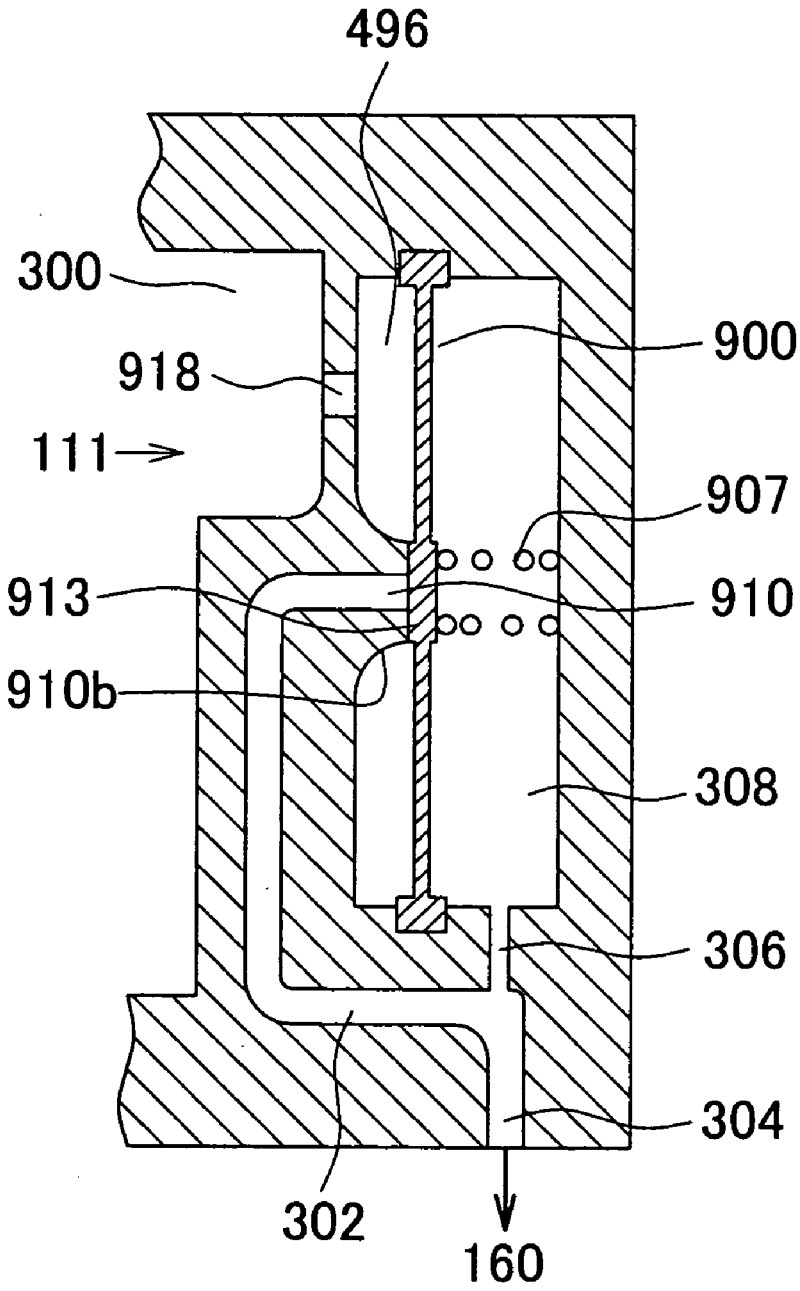
FIG. 11A show sa structure of an ink supply controlling means in a state where a valve is opened.
Figure 11B:
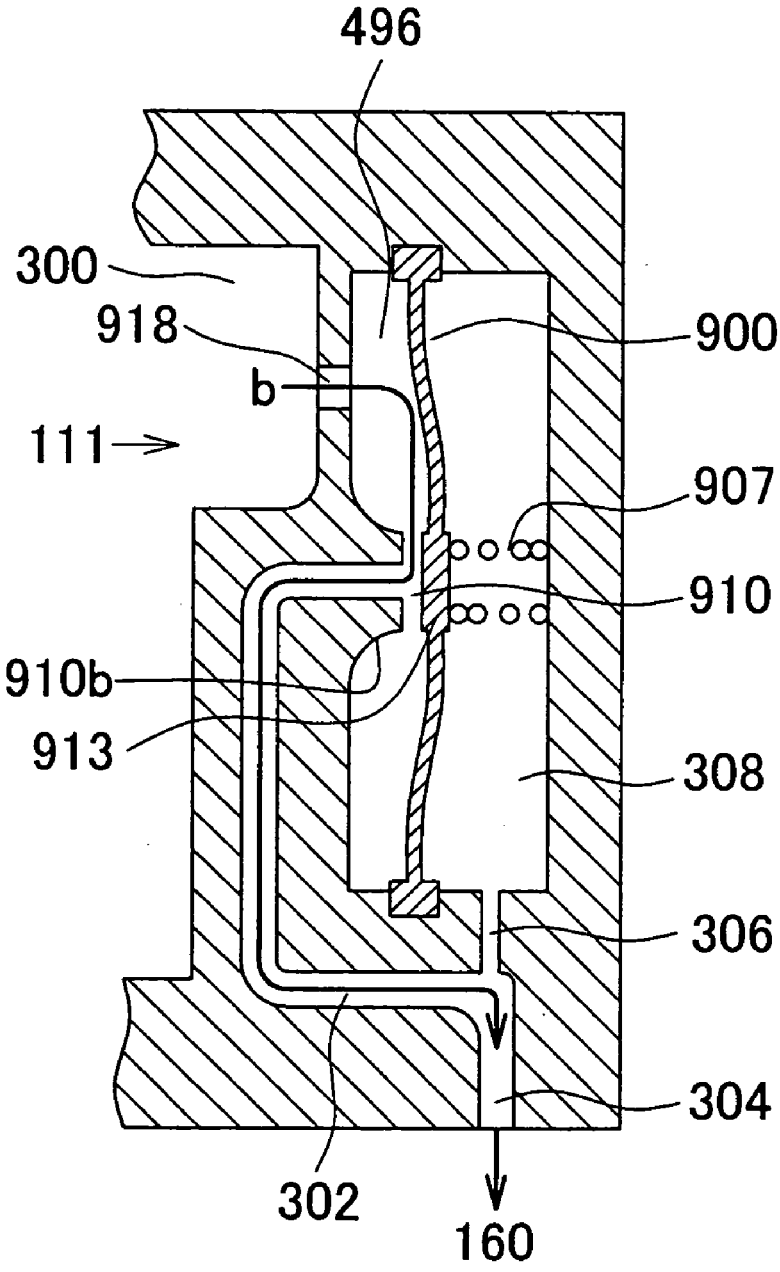
FIG. 11B shows a structure of an ink supply controlling means in a state where a valve is closed.

FIGS. 11A and 11B show a structure of the ink supply controlling means 150 of the ink cartridge 100 shown in FIGS. 10A and 10B simply. FIGS. 11A and 11B simply show a structure of the ink supply controlling means 150 described above in both states where the valve is opened and closed, and the configurations similar to those in FIGS. 10A and 10B have the same symbols.

As shown in FIG. 11A, in the closed state, since the body part side projecting part 913 of the membrane valve 900 is in contact with the passage hole projecting part 910*b* of the passage hole 910 by the urging force of the coil spring 907 so that the passage hole 910 is closed, the ink of the ink accommodating section 111 is prevented from leaking out to the ink supplying part 160.

When the ink is consumed from the ink supplying part 160 by the recording head of the inkjet type recording apparatus on which the ink cartridge 100 is mounted, the pressure of the ink supplying part 160 is decreased, and the pressure of the membrane valve chamber 308 is decreased via the communicating parts 304 and 306. Therefore, the pressure of the overall membrane valve chamber 308 side in regard to the membrane valve 900 is decreased. Meanwhile, although the pressure near the passage hole 910 via the communicating part 302 in regard to a surface of the communicating passage 496 side in regard to the membrane valve 900 is decreased, the pressure around the passage hole 910 is not decreased. Therefore, if the force caused by the pressure difference that occurs between both sides of the membrane valve 900 becomes larger than the urging force given to the membrane valve 900 by the coil spring 907, as shown in FIG. 11B, the body part side projecting part 913 of the membrane valve 900 is separated from the passage hole projecting part 910*b* so that the passage hole 910 opens. Thus, the ink flows in a sequence of the communicating part 300, the passage hole 918, the communicating passage 496 and the communicating part 302 and 304, and is supplied to the recording head from the ink supplying part 160 (the arrow b in FIG. 11B).

At this time, the ink flows via only the communicating passage 496 side of the membrane valve 900, and thus though bubbles held up in the communicating part 300 are got in, they flow into the recording head along with the stream of the ink. Therefore, these bubbles do not get into the membrane valve chamber 308. Thus, the pressure change of the ink supplying part 160 side affects the membrane valve 900 securely, and it is possible to supply the ink of the ink accommodating section 111 to the recording head without fail. In addition, although the bubbles flow into the recording head, it is possible to eliminate the bubbles easily by discharging the ink compulsorily by applying the negative pressure to the recording head.

In addition, as shown in FIG. 10B, the passage hole 910 has an expanding part 910*a* that expands gradually toward the communicating part 302. Thus, the passage resistance of the ink flowing into the communicating part 302, of which the cross-section area is larger than the passage hole 910 through the passage hole 910, becomes small. Meanwhile, if a passage hole is provided at the membrane valve 900, the membrane valve 900 is too thin so that it is difficult to provide the expanding part at the passage hole, and thus it is impossible decrease the passage resistance of the ink flowing through the passage hole. Therefore, in the present embodiment, it is possible to decrease the passage resistance of the ink passing the passage hole 910 in contrast to the case the passage hole is provide at the membrane valve 900 side.

Since the ink is supplied to the membrane valve chamber 308 and the ink supplying part 160 via the communicating part 302 in the opened state, the pressure difference between the membrane valve chamber 308 and the communicating part 300 is eliminated. Thus, the body part side projecting part 913 of the membrane valve 900 closes the passage hole 910 by being repelled by the urging force of the coil spring 907, and blocks the communicating passage 496. By repeating the operations above, the ink contained in the ink accommodating section 111 is supplied to the inkjet type recording apparatus.

In regard to the ink supply controlling means 150, the valve lid side projecting part 902 of the membrane valve 900 is the shape of a cylinder, and the outer shape or diameter of the cross-section is slightly larger than the inner diameter of the coil spring 907. However, the configuration of the valve lid side projecting part 902 is not limited to this. As another example, the membrane valve 900 may project toward the valve lid 151 in regard to the center part, and may have a valve lid side cylinder part of a cylindrical shape of which a part of the inner diameter is smaller than the outer diameter of the coil spring 907. In this case, the coil spring 907 is inserted into the valve lid side cylinder part, so that the coil spring 907 is engaged with the membrane valve 900. Accordingly, the coil spring 907 can be engaged to be positioned to the membrane valve 900 accurately.

The membrane valve 900 shown in FIGS. 10A and 10B closes the passage hole 910 with the urging force of the coil spring 907 by the body part side projecting part 913 that projects toward an opposite side to the coil spring 907. However, the configuration to close the passage hole 910 is not limited to this.

Figure 12:
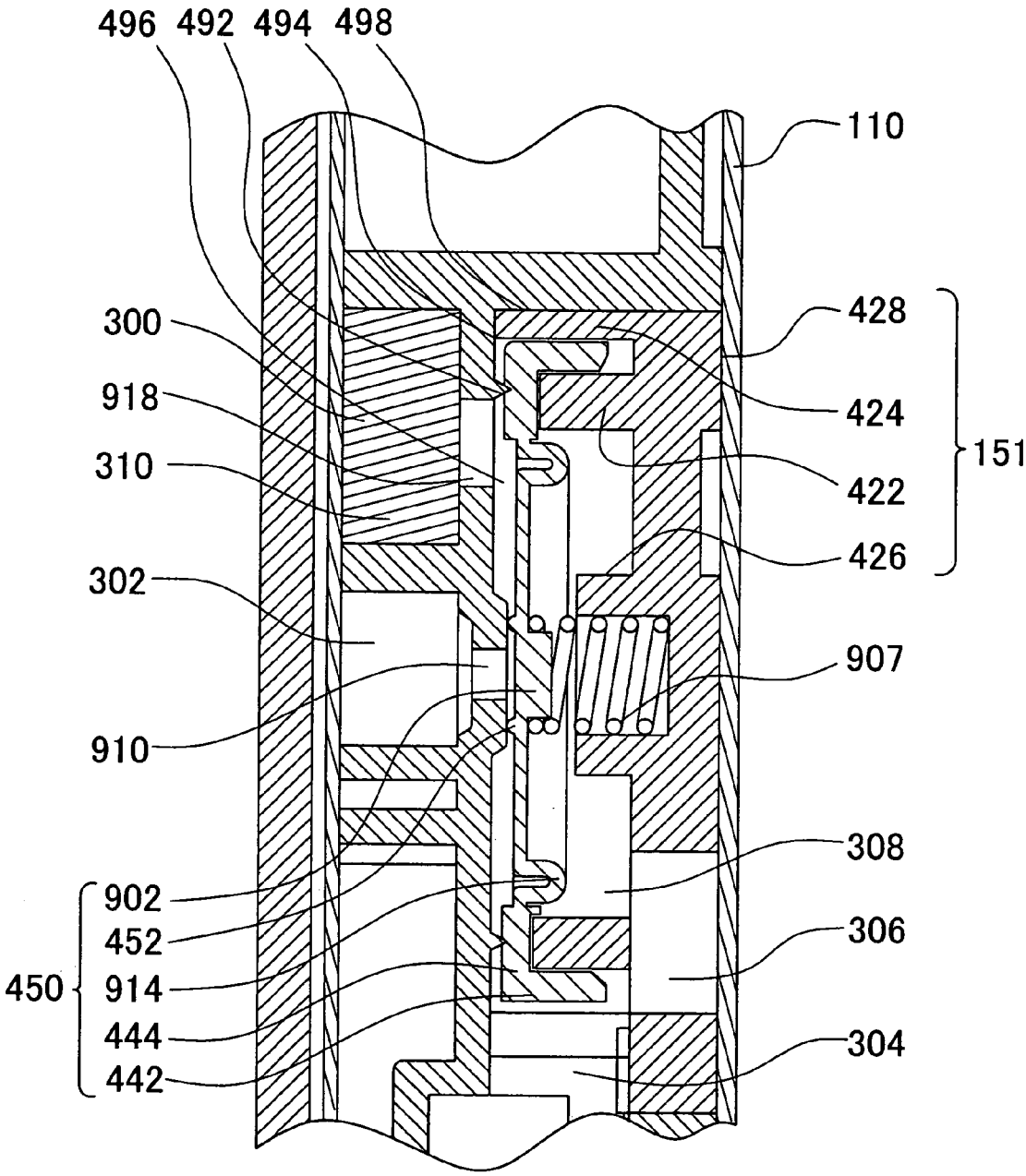
FIG. 12 is a cross-sectional view of another embodiment of a membrane valve.

FIG. 12 is a cross-sectional view of another embodiment of a membrane valve 450 corresponding to that in FIG. 10B. The configurations in FIG. 12 similar to those in FIG. 10B are given the same reference number, and the description of them will be omitted. The membrane valve 450 shown in FIG. 12 has a seal part 452 that projects toward an opposite side to the coil spring 907. The seal part 452 corresponds to a position where it is urged by the coil spring 907 and is provided to be circular to surround the passage hole 910. Thus, it is possible to use the urging force resulting from the coil spring 907 as a force to close the passage hole 910 securely.

As described above, according to the present embodiment, the circular projection 492 of the cartridge body 120 is pressed to be in contact with the membrane valve 450, and thus it is possible to attach the membrane valve 450 to the cartridge body 120 without the dust that occurs during attaching by ultrasonic welding. In addition, according to the present embodiment, since the membrane valve 450 and the coil spring 907 are held in the valve lid 151 so that the pressure-difference regulating valve unit can be formed, it is easy to position them each other. In addition, the coil spring 907 is held between the membrane valve 450 and the valve lid 151, and thus a fixture for attaching the coil spring 907 to the cartridge body 120 is not needed. Therefore, it is possible to attach them easily.

Moreover, in the present embodiment described above, the passage hole 910 is formed at the center part in regard to the wall face 494 of the pressure-difference regulating valve unit containing section 495, and thus the membrane valve 450 of the ink supply controlling means 150 is moved corresponding to the pressure of the ink supplying part 160 side to close the passage hole 910. However, the shape of the membrane valve 450 is not limited.

Figure 13A:
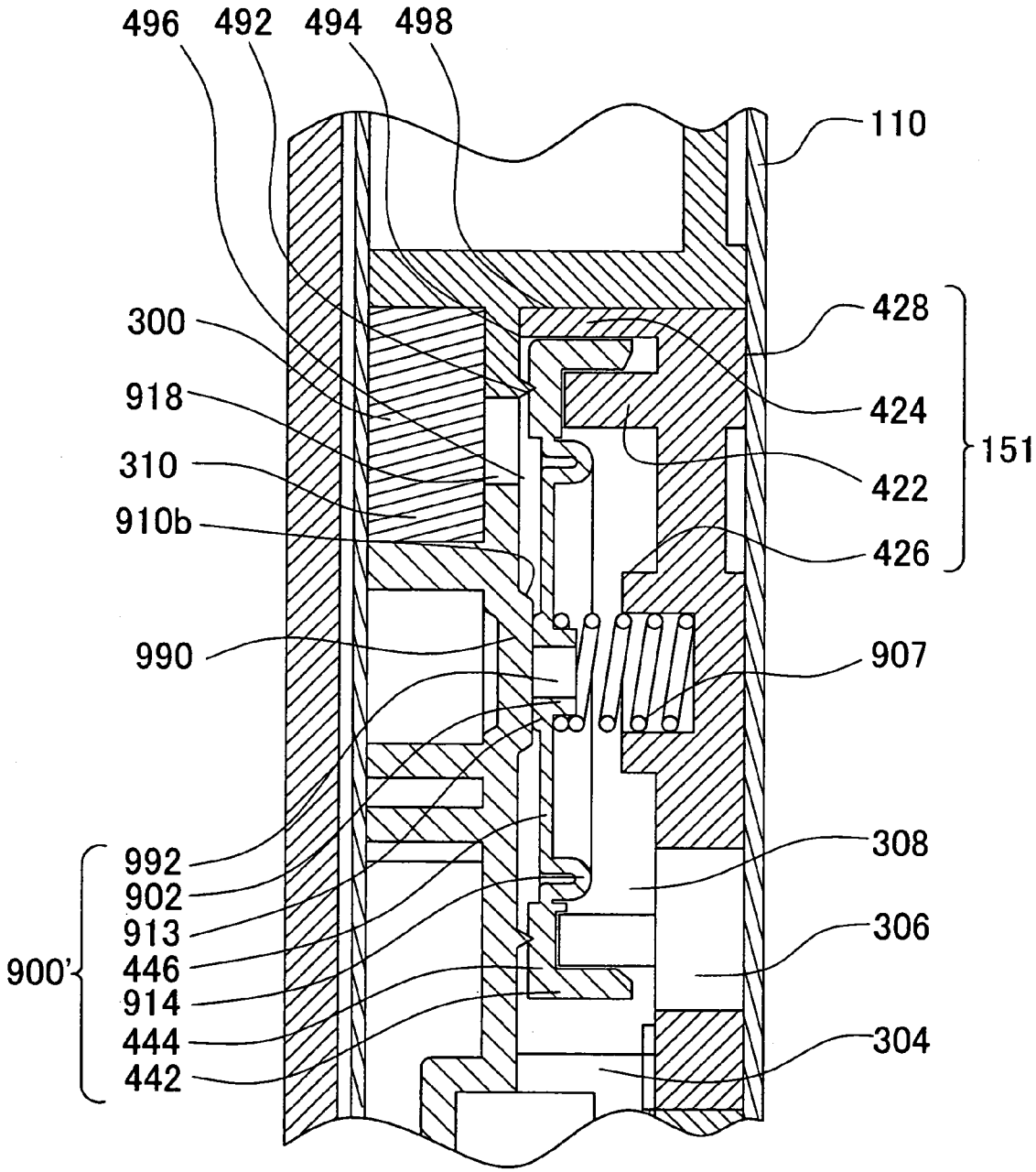
FIG. 13A is a cross-sectional view of another embodiment of a membrane valve.
Figure 13B:
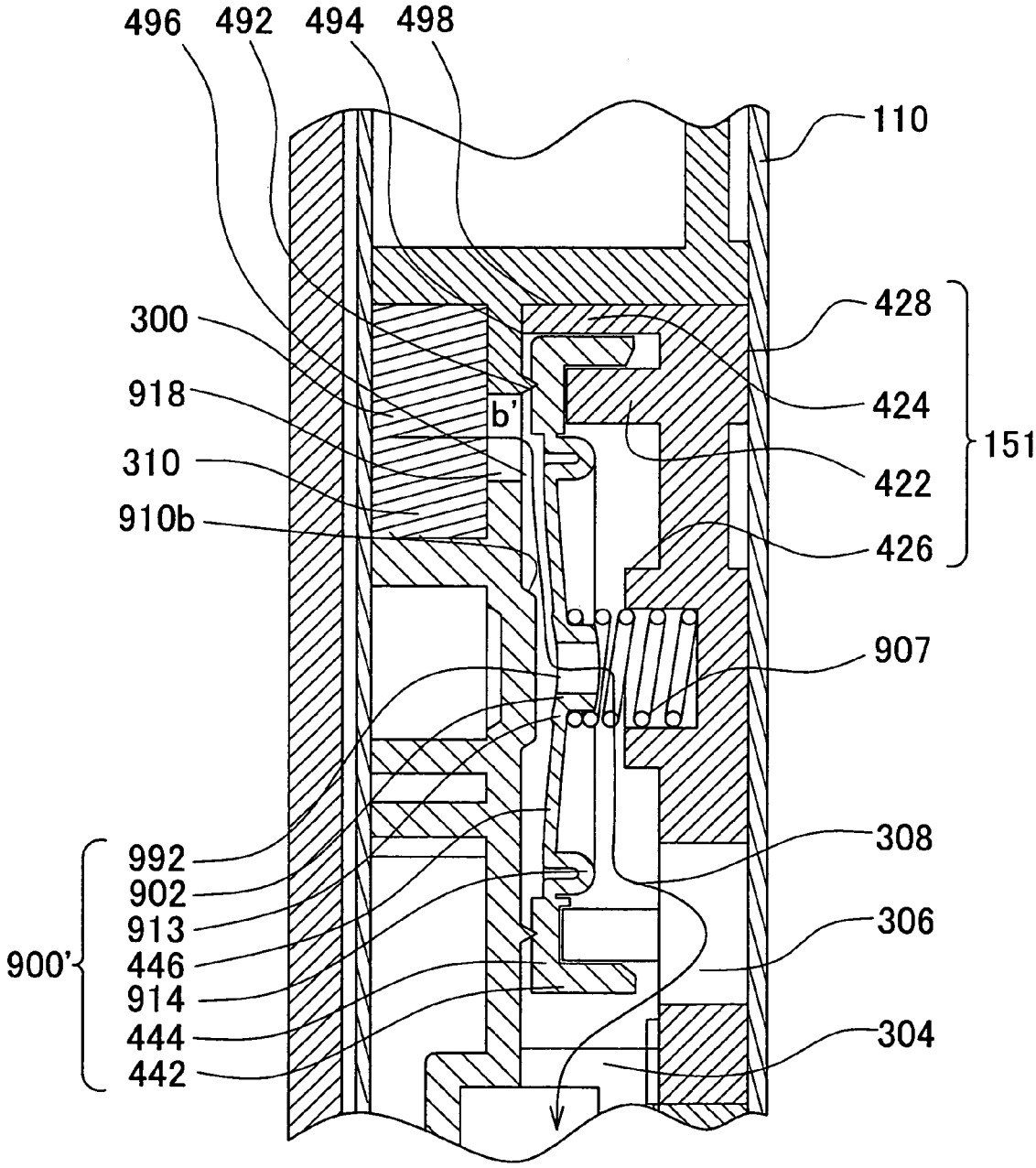
FIG. 13B is a cross-sectional view of another embodiment of a membrane valve.

FIGS. 13A and 13B are cross-sectional views of another embodiment of a membrane valve of the ink supply controlling means 150. In FIGS. 13A and 13B, the configurations similar to the ink cartridge 100 shown in FIG. 10B are given the same reference number, and the description of them will be omitted.

As shown in FIG. 13A, one passage hole 918 is provided at an area except the center area in regard to the wall face 494 of the pressure-difference regulating valve unit containing section 495, and a projecting part 990 is provided at the center part. A communicating hole 992 that is in elastically contact with the projecting part 990 is formed at the center of a membrane valve 900' of the ink supply controlling means 150. Thus, a surface of the valve lid 151 side in regard to the membrane valve 900' is connected to the ink supplying part 160, and besides a surface of the wall face 494 side in regard to the membrane valve 900' communicates with the ink accommodating section 111 through the passage hole 918. Usually, the membrane valve 900' is pressed by the coil spring 907 toward the projecting part 990 of the pressure-difference regulating valve unit containing section 495 so that the communicating hole 992 of the membrane valve 900' is sealed. When the pressure of the ink supplying part 160 side decreased because the ink is consumed by ejecting from the recording head, as shown in FIG. 13B, the membrane valve 900' is separated from the projecting part 990 against the coil spring 907, and the ink acts similar to the embodiment shown in FIG. 10B via the communicating hole 992 of the membrane valve 900' along the passage shown by an arrow b' in the drawing.

In the present embodiment above, it has been described that the pressure-difference regulating valve unit containing section 495 is formed on an outer surface of the cartridge body 120, but the pressure-difference regulating valve unit containing section may be form at the ink supplying part 160 to contain the pressure-difference regulating valve unit as a concave part.

Although the present invention has been described by way of exemplary embodiments, it should be understood that those skilled in the art might make many changes and substitutions without departing from the spirit and the scope of the present invention which is defined only by the appended claims.

What is claimed is:

1. A liquid cartridge comprising:

a liquid containing section for containing a liquid;

a cartridge body having a liquid supplying part that supplies the liquid in said liquid containing section to outside, a wall face, and a concave part formed in the wall face of the cartridge body, the concave part itself having a wall face;

a valve member contained in the concave part of said cartridge body and which opens when a sufficient pressure difference between said liquid containing section and said liquid supplying part occurs;

a valve lid that holds said valve member by being fitted into said concave part and also presses an outer circumference of said valve member toward the wall face of said concave part;

a projection formed on a surface of said wall face in said concave part, said valve member contacting said projection to be in pressure contact with said valve member along said outer circumference of said valve member;

a seal member that urges an outer surface of said valve lid opposite to a surface, on which said valve member is provided, and a wall face of said cartridge body around said outer surface of said valve lid in a direction so that said valve lid is in contact with said projection.

2. A liquid cartridge as claimed in claim 1, wherein said valve lid includes a valve member contact part provided to face said projection holding said valve member and press said valve member toward said projection by being in contact with said valve member.

3. A liquid cartridge as in claim 2, wherein said valve member includes a bent part provided at a position closer to a center part thereof than a position where said projection is in contact.

4. A liquid cartridge as claimed in claim 1, wherein said valve member is formed of an elastic material, and said projection presses against said valve member, deforming said valve member.

5. A liquid cartridge as in claim 1, wherein said valve member is softer than said projection.

6. A liquid cartridge as in claim 1, further comprising:

an urging member provided between said valve member and said valve lid for urging said valve member in a direction away from said valve lid, and wherein said valve member includes a seal part that projects toward an opposite side to said urging member corresponding to a position at which said valve member is urged by said urging member, for preventing said liquid containing section and said liquid supplying part from communicating with each other by being urged by said urging member toward the wall face side of the concave part formed of said cartridge body.

7. A liquid cartridge as in claim 1, further comprising:

a coil spring provided between said valve member and said valve lid to urge said valve member in a direction away from said valve lid; and wherein said valve member includes a valve lid side projecting part of substantially cylindrical shape, and of which at least a part of an outer diameter is larger than an inner diameter of said coil spring, projecting toward said valve lid at a position where said coil spring contacts said valve member, and wherein at least a portion of said valve lid side projecting part projects into said coil spring.

8. A liquid cartridge as in claim 1, further comprising:

a coil spring provided between said valve member and said valve lid to urge said valve member in a direction away from said valve lid; and wherein said valve member includes a substantially cylindrical valve lid side projecting part, and of which at least a part of an inner diameter is smaller than an outer diameter of said coil spring, projecting toward said valve lid at a position where said coil spring contacts said valve member, and wherein at least a portion of said coil spring is fitted into said valve lid side projecting part of said valve lid.

9. A liquid cartridge as in claim 1, wherein said valve lid further includes a substantially cylindrical wall face contact part provided around said valve member contact part; and wherein said wall face contact part is thicker than both said valve member contact part and a part of said valve member with which said valve member contact part is in contact.

10. A liquid cartridge as in claim 1, wherein the valve member does not have a through hole.

11. A valve unit accommodated within a liquid cartridge body which includes a liquid containing section that contains liquid therein and a liquid supplying section that supplies the liquid to outside of the cartridge body, the valve unit comprising:

a valve member which is elastically deformable to open when there is a sufficient pressure difference between the liquid containing section and the liquid supplying section, said valve member having a cylindrical peripheral edge;

a valve lid having a substantially cylindrical valve member holding part disposed within said peripheral edge of said valve member to fix said peripheral edge; and an urging member provided between said valve member and said valve lid to urge said valve member in a direction away from said valve lid.

12. A valve unit as claimed in claim 11, wherein said valve lid further includes a wall surface contact part of a substantially cylindrical shape, of which an inner diameter is larger than an outer diameter of said peripheral edge part of said valve member, surrounding said valve member holding part, and contacting a wall face of a concave part of said cartridge body to which said valve lid is attached.

13. A valve unit as claimed in claim 11, wherein said urging member is a coil spring, said valve lid includes a cylindrical spring fitting part, of which an inner diameter is substantially the same as an outer diameter of said coil spring, the cylindrical spring fitting part projecting toward said valve member at a position where said coil spring is in contact, and said coil spring is held in said valve lid by being least partially contained within said spring fining part.

14. A valve unit as claimed in claim 13, wherein said spring fitting part has a notch through which a liquid flows into and/or out of said spring fitting part, even when said coil spring is contained within said spring fitting part.

15. A valve unit as claimed in claim 14, wherein said spring fitting part has a plurality of notches cut in away from said valve member to define a plurality of projecting pieces, and wherein at least one of the projecting pieces has a dimension in a surface direction that is larger than an inner diameter of said coil spring.

16. A valve unit as claimed in claim 11, wherein said urging member is a coil spring, wherein said valve member includes a substantially cylindrical valve lid side projecting part, and of which at least a part of an outer diameter is larger than an inner diameter of said coil spring, projecting toward said valve lid at a position where said coil spring contacts said valve member, and wherein at least a portion of said valve lid side projecting part projects into said coil spring.

17. A valve unit as claimed in claim 11, wherein said urging member is a coil spring, wherein said valve member includes a substantially cylindrical valve lid side projecting part, and of which at least a part of an inner diameter is smaller than an outer diameter of said coil spring, projecting toward said valve lid at a position where said coil spring contacts said valve member, and wherein at least a portion of said coil spring is fitted into said valve lid side projecting part of said valve lid.

18. A valve unit as claimed in claim 11, wherein said valve member includes a seal part projecting away from said urging member at a location corresponding to a position where said valve member is urged by said urging member, to prevent said liquid containing section and said liquid supplying part from communicating with each other by being urged by said urging member toward a wall face side of a concave part of said cartridge body.

19. A liquid cartridge comprising said valve unit as claimed in claim 11.

20. A valve unit as in claim 11, wherein the valve member does not have a through hole.

21. A method for manufacturing a liquid cartridge, which includes a liquid containing section for containing a liquid, a cartridge body having a liquid supplying part that supplies said liquid in said liquid containing section to outside, a wall face, and a concave part formed in the wall face of the cartridge body, the concave part itself having a wall face, and a valve unit comprising a valve member contained in said cartridge body and which opens when a sufficient pressure difference between said liquid containing section and said liquid supplying part occurs, the valve member having a peripheral edge part, of which a peripheral edge is cylindrical in shape, and which is elastically deformable based on said pressure difference, comprising the steps of:

preparing said cartridge body having said liquid containing section and a valve unit containing section, which is the concave part formed in said cartridge body, communicating with said liquid containing section;

forming a valve unit by putting an urging member, which urges said valve member in a direction away from said valve lid, between said valve member and a valve lid having a substantially cylindrical valve member holding part that fixes said peripheral edge part by being inserted into said peripheral edge part of said valve member; and attaching said valve unit to said valve unit containing section.

22. A method for manufacturing a liquid cartridge as claimed in claim 21, further comprising a step of sealing with a sealing member an outer surface of said valve lid opposing a surface on which said valve member is provided and a wall face of said cartridge body around said outer surface of said valve lid.

23. A method for manufacturing a liquid cartridge as claimed in claim 21, wherein said attaching step includes a step of forcing a projection to be in pressure contact with said valve member, and said projection is provided along an outer circumference of said valve member on a wall face with which said valve member of said valve unit containing section is in contact.

24. A method as in claim 21, wherein the valve member does not have a through hole.

* * * * *